US005210573A

United States Patent [19]

Fukuchi et al.

[11] Patent Number: 5,210,573

[45] Date of Patent: May 11, 1993

[54] IMAGE FORMING APPARATUS

[75] Inventors: Masakazu Fukuchi; Shizuo Morita; Satoshi Haneda; Hisao Satoh; Tadayoshi Ikeda, all of Hachioji, Japan

[73] Assignee: Konica Corporation, Tokyo, Japan

[21] Appl. No.: 734,521

[22] Filed: Jul. 23, 1991

[30] Foreign Application Priority Data

Jul. 26, 1990 [JP] Japan ..... 2-200787
Sep. 7, 1990 [JP] Japan ..... 2-238473
Oct. 20, 1990 [JP] Japan ..... 2-282591

[51] Int. Cl.[5] ..... G03G 5/00
[52] U.S. Cl. ..... 355/211; 355/200
[58] Field of Search ..... 355/210–213, 355/203, 204, 208, 72, 326, 327, 200, 260

[56] References Cited

U.S. PATENT DOCUMENTS 4,751,552 6/1988 Itoigawa ..... 355/200
4,862,212 8/1989 Tanzawa et al. ..... 355/260 X
4,990,966 2/1991 Siudo ..... 355/321
5,047,803 9/1991 Kanoto ..... 355/211

FOREIGN PATENT DOCUMENTS 0331324 9/1989 European Pat. Off. ..... 355/210
0411825 2/1991 European Pat. Off. ..... 355/210
0008653 1/1988 Japan ..... 355/210
0138359 6/1988 Japan ..... 355/211
0149655 6/1988 Japan ..... 355/210
0249156 8/1988 Japan ..... 355/210

*Primary Examiner*—A. T. Grimley
*Assistant Examiner*—Matthew S. Smith
*Attorney, Agent, or Firm*—Frishauf, Holtz, Goodman & Woodward

[57] ABSTRACT

An image forming apparatus provided with a process-cartridge for therein fixing at least an image carrying body. The process-cartridge is adapted to be inserted to the main body of the apparatus at a first position suitable for image forming operation and is adapted to be relased to a second position suitable for pulling out of the process-cartridge from the main body.

6 Claims, 27 Drawing Sheets

FIG. 12

| JAM POSITION | PROCESS CARTRIDGE MOVING MEANS | CASSETTE MOVING MEANS |
|---|---|---|
| S0 PAPER SENSER | | ○ |
| S1 PAPER FEEDER | | ○ |
| S2 TIMING | ○ | ○ |
| S3 TRANSFER | ○ | |
| S4 PAPER DELIVERY | | |

IMAGE FORMING APPARATUS

BACKGROUND OF THE INVENTION

The present invention relates to an image forming apparatus of an electrophotographic type for forming an image on an image-transfer material such as those used in a copying machine and a printer.

For an image forming apparatus such as an anolog type copying machine of a monocolor system employing an electrophotographic system, and a copying machine and a printer having therein a scanning system by means of a semiconductor laser and an LED, there have been proposals wherein a part of an image forming means is united to be a cartridge for replenishment or replacement, on occasion of consumption, of various kinds of photoreceptors, developer carriers, cleaning members and developer toners, each having their own lives, and primary portions of the aforementioned image forming means are united in a body which may be pulled out of the apparatus for maintenance or replacement. In addition, there have been proposals wherein a transport path for an image-transfer material on which an image is to be formed by an image forming means is opened so that the image-transfer material may be taken out easily for jam clearing.

As a typical example of the aforesaid constitution, there has been a proposal in Japanese Patent Examined Publication No. 54392/1983 wherein a photoreceptor drum, a developing unit and a cleaner are mounted solidly on a supporting member to be one unit so that the unit can be pulled out of the main body of an apparatus for easy replacement or maintenance of each unit. Further, in Japanese Patent Publication Open to Public Inspection No. 154255/1982 (hereinafter referred to as Japanese Patent O.P.I. Publication), the primary portions of an image forming means are united to be a disposable type, and in Japanese Patent O.P.I. Publication No. 147366/1984, there has been disclosed printer constitution wherein a disposable cartridge is used and a latent image is formed on a photoreceptor drum through scanning writing by means of dot exposure. Further, in those publications mentioned above, there have been disclosed separated shell structures wherein an upper half can be opened to cause a transport path for an image-transfer material to be accessible for clearing the jammed image-transfer material, and in the aforesaid Japanese Patent O.P.I. Publication No. 154255/1982, there has been disclosed a halved structure wherein a disposable process cartridge is provided on an upper half on a replaceable basis so that easy replacement of the cartridge and easy clearing of jamming may be attained. In Japanese Patent O.P.I. Publication No. 1161/1983, there has further been disclosed a technology wherein a halved structure is employed for easy replacement of a process cartridge mainly represented by a toner cartridge for replenishment and a cleaning cartridge for collected toners, and a process cartridge is provided in a lower half in particular for improvement of maintenance work.

Vertical types of the aforesaid structure have been disclosed in Japanese Patent O.P.I. Publication Nos. 244058/1988, 244059/1988, 244064/1988 and 179168/1989, and their aims are to attain the operations in the same direction and an improvement of jam clearing.

In Japanese Patent O.P.I. Publication No. 279870/1986, there has been disclosed an image forming apparatus wherein easy handling and operation of consumable supplies are attained and restriction of space for operation is reduced by causing the loading direction for image-transfer materials and the direction for loading or unloading of a process cartridge provided on an upper half to be the same.

When an operator moves movable portions to open the transport path for image transfer materials for securing the working space for jam clearing, the operator's work has been complicated and time-consuming. In addition, working space for jam clearing is narrow beyond expectation and a space for a hand for removing jammed sheets is not enough. An operator has opened a transport path for pinpointing jammed sheets based on the operator's judgment made from the display for a position of jam occurrence. However, when the transport path is complicated (especially, in case of image forming apparatuses for color, duplex, high speed or high-level functions), there are plural movable portions which need to be moved concurrently for opening the transport path. Thus, the operator has been puzzled and operated erroneously while wasting time, which has caused various problems. In addition, an image forming apparatus is generally installed at the height of the waist of an operator. Therefore, the operator has to locate the jammed sheet and clear it in an unnatural posture such as a half-sitting posture or a posture of leaning over, which results in inefficient work. Anyway, since an operator has to move movable portions for opening a transport path, work efficiency is not high and there is a risk of an injury on a human body when an operator puts all the strength of his body into his arms or when he inserts his hand into a narrow space.

On the other hand, when replacing process cartridges and cassettes, they have needed to be drawn far out of a main body of an apparatus and its work has been complicated in the past. In addition to that, considerable power has been required for an operator and he has sometimes dropped the process cartridges and cassettes because of their heavy weight and contact between a cassette and a sheet feeding roller. Namely, these jam clearing work and replacement work have been complicated and time-consuming, and it has been impossible to do the work in a simple and safe way, which has been a disadvantage.

When loading a process cartridge in or unloading it from a main body of an apparatus, it has been necessary that the apparatus is of a halved structure so that an inlet for a cartridge may be opened and closed. In addition to that, gears in a driving system linked with a photoreceptor and with a developing unit have been required to be set or removed easily and securely, resulting in a complicated structure of the main body of the apparatus and complicated handling and operation.

SUMMARY OF THE INVENTION

An object of the invention is to provide an image forming apparatus wherein enough space for jam clearing is secured, jam clearing and replacement of process cartridges are simple, and maintenance can be done efficiently. Its further object is to provide an image forming apparatus wherein jam clearing and replacement of a process cartridge can be done safely and simply even in case of a relatively heavy process cartridge such as one for a color image forming apparatus.

Further object of the invention is to provide an image forming apparatus wherein a process cartridge can be loaded or unloaded easily and firmly even when the apparatus does not open widely or close, differing from a halved structure in which the apparatus opens widely or closes.

Another object of the invention is to provide an image forming apparatus wherein movement and replacement of a process cartridge can be done through a simple operation, and even a beginner can take actions simply and firmly for excellent maintenance for coping with troubles such as occurrence of transport failure.

The aforesaid objects are attained by an image forming apparatus comprising a detachable process cartridge wherein an image carrier on which a latent image is formed and at least one of a developing means and a cleaning means are united, a process cartridge moving means that moves the process cartridge from its first position where an image can be formed to its second position that is located in the direction opposite to the direction for inserting the process cartridge, an upper cover detection means that is provided rotatably on the apparatus and detects the opening of an upper cover and outputs signals for the opening, and a control means that outputs the movement signals to the process cartridge moving means based on the signals for the opening.

The aforementioned object may also be attained by an image forming apparatus wherein a process cartridge including at least an image carrier can be mounted on or dismounted from the main body of the image forming apparatus, an inlet for the process cartridge is provided with a cover member that can be opened or closed, the cover member is provided to be linked with a fixing means for the process cartridge, and opening and closing of the cover member are linked respectively with fixing of the process cartridge to the image forming position and releasing thereof from the image forming position.

The aforementioned object is attained by the following technical means representing an image forming apparatus wherein a process cartridge which includes an image carrier and is provided, on a slidable basis, on the main body of an image forming apparatus is released horizontally or upward obliquely for a certain distance, through linkage with opening operation of an enclosure cover provided on the front side of the apparatus for coping with occurrence of transport trouble for image transfer materials and/or with maintenance of periodic check, so that the process cartridge may be mounted or dismounted.

The aforementioned object may be attained by either one of the following technical means (a), (b), (c) and (d).

(a) An image forming apparatus wherein a release for a certain distance made through linkage with signals generated on the occurrence of transport troubles for image-transfer materials or of periodic check for a process cartridge of a unit type which is provided, on a slidable basis, on the main body frame of the image forming apparatus is interlocked with the opening of an enclosure cover provided in the direction of the release.

(b) An image forming apparatus wherein the aforesaid enclosure cover is composed of a part of the aforementioned process cartridge.

(c) An image forming apparatus wherein the aforementioned enclosure cover opened is caused to be a guide means for the process cartridge mentioned above.

BRIEF DESCRIPTION OF THE DRAWINGS

FIG. 12 is a diagram showing the control for a moving means for a process cartridge and a moving means for a cassette based on the position of jam occurrence.

DETAILED DESCRIPTION OF THE PREFERRED EMBODIMENTS

The invention will be explained as follows referring to the examples shown in attached drawings.

Figure 1:
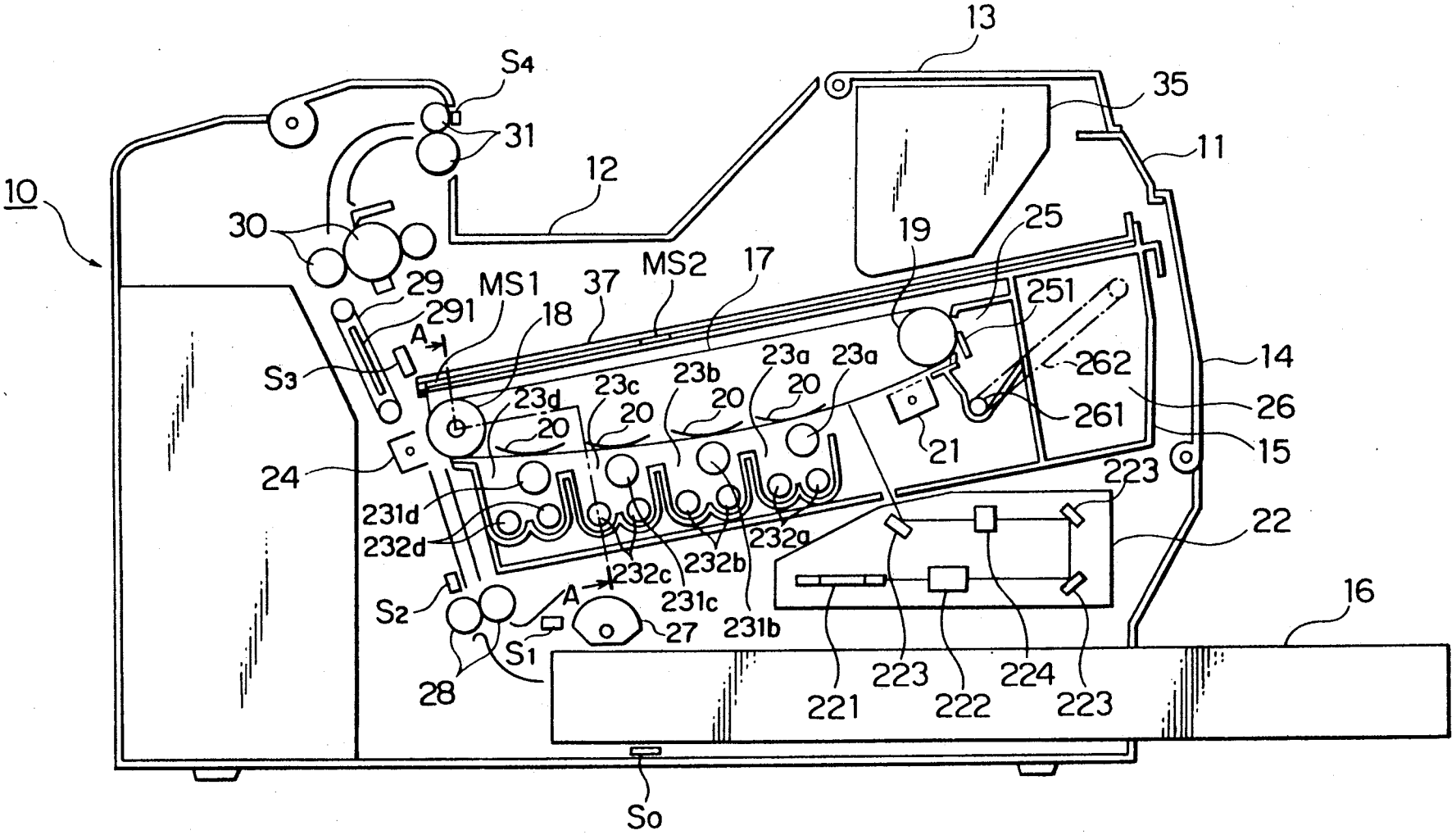
FIG. 1 is a diagram showing from the left side the primary sectional view of a color printer to which the invention is applied.

FIG. 1 represents from the left side a primary section of a color printer to which the invention is applied. Apparatus main frame 10 is surrounded by operation panel 11 located on the front side of the printer, upper cover 12 capable of opening and closing, toner supplying cover 13 and front cover 14, and inside of the printer, there are provided process cartridge 15 capable of being mounted or dismounted and sheet-feeding cassette 16.

In FIG. 1, photoreceptor belt 17 that is an image carrier and is a flexible belt having thereon a coated light-sensitive layer is spread between driving roller 18 and driven roller 19. The driving roller 18 is rotated through the driving gear engaged with a gear provided on the apparatus main frame 10 (to be stated later), and it transports the photoreceptor belt 17 clockwise. Owing to distance-holding member 20, the distance between the photoreceptor belt 17 and developing units **23*a*–23*d* is kept constant to form stably excellent images. In the present example, photoreceptor belt 17** is used as an image carrier, but the invention is not limited to this and it can also be applied to the conventional image carrier having thereon a light-sensitive layer such as a photoreceptor drum.

Around the photoreceptor belt 17, there are provided charging means 21, exposure means 22, developing means **23*a*–23*d*, transfer means 24 and cleaning means 25**.

The charging means is provided for charging uniformly the light-sensitive layer on the photoreceptor belt 17 with predetermined polarity, and it is a conventional charger 21 such as a corona charger or a scorotron charger. For an OPC photoreceptor, a scorotron charger is used preferably.

An exposure means is semiconductor laser writing unit 22, and it causes the surface of photoreceptor belt 17 charged by charger 21 to be exposed for formation of a latent image.

Developing means include a plurality of developing units **23*a*–23*d* each containing a developer of a different color such as, for example, a yellow toner, a magenta toner, a cyan toner and a black toner each representing a developer. Each of these developing units is equipped with each of developing sleeves 231*a*–231*d* which keep a certain distance from the photoreceptor belt 17 and with each of agitating screws 232*a*–232*d* which agitate toners of different colors, and it has a function to develop a latent image on photoreceptor belt 17 to be a visible toner image through a non-contact developing method. In the non-contact developing method, it is possible to obtain an excellent color image because preceding toner images formed on the photoreceptor belt 17 are not damaged and the movement of the photoreceptor belt 17 is not disturbed, which is different from a developing method of a contact type. The developing means is not limited to one in the present example wherein different four colors are used, but it can employ a single color, two colors or three colors, and in such cases, developing units in number equivalent to the number of colors employed may be provided around the photoreceptor belt 17**.

The transfer means transfers toner images formed on the photoreceptor belt 17 onto an image-transfer material by means of transfer unit 24 such as a transfer corona discharger. As a transfer means, a conventional transfer member such as a transfer drum may be used in place of the transfer unit 24.

Cleaning means 25 is equipped with cleaning blade 251 and is kept away from the surface of the photoreceptor belt 17 during the period of an image forming process, while it is caused to be in pressure-contact with the surface of photoreceptor belt 17 only when cleaning after transferring of toner images onto an image-transfer material so that the photoreceptor belt 17 may be cleaned.

Collecting box 26 is for collecting residual toners on the photoreceptor belt 17 removed by cleaning means 25 through toner collecting tube 262 by means of waste toner screw 261, and for containing them.

In the present example, processing units such as photoreceptor belt 17, charger 21, developing units **23*a*–23*d* containing respectively toners of different colors, cleaning means 25 and toner collecting box 26 all of which compose an image forming unit are housed in solid process cartridge 15 to form a unit so that the unit may be mounted on or dismounted from apparatus main frame 10. However, processing units housed in the process cartridge 15 to be a unit are not limited to these processing units, instead, a unit of at least photoreceptor belt 17 and developing units 23*a*–23*d* or a unit of at least photoreceptor belt 17** and cleaning means is enough, and other processing units may also be included as a unit.

The process for forming color images by means of a color image forming apparatus having the aforementioned structure is as follows.

First, process cartridge 15 is located at the first position where images can be formed. Then, when image signals for the first color generated from an image reading device that is separate from the apparatus main frame 10 are inputted in the aforesaid laser reading unit 22, a laser beam is generated from a semiconductor laser (not shown) in the laser reading unit 22. The laser beam is caused by polygon mirror 221 rotated by driving motor (not shown) to scan, through $f\theta$ lens 222, cylindrical lens 224 and three mirrors 223, the surface of photoreceptor belt 17 charged uniformly by charger 21 in advance to a predetermined level of electric charge to form an emission line.

On the other hand, with regard to a sub-scanning direction, a belt index (not shown) corresponding to a specific position on the photoreceptor belt 17 is detected, or, print command signals are received, and the standards of such detection or command signals determine a main scanning line which starts modulation of a semiconductor laser. After scanning is started, with regard to the direction of main scanning, a laser beam is detected by an index sensor (not shown), and modulation of a semiconductor laser by means of image signals for the first color is started with the detected signals as a standard, and then the modulated laser beam scans the surface of the photoreceptor belt 17. Therefore, a latent image corresponding to the first color is formed on the surface of the photoreceptor belt 17 charged uniformly through the main scanning by means of the laser beam and the sub-scanning by means of transport of the photoreceptor belt 17. The latent image thus formed is developed by developing unit **23*a* containing yellow toners which correspond to the first color among developing means, and thereby a yellow toner image is formed on the surface of the photoreceptor belt 17. After that, the photoreceptor belt 17 passes under cleaning blade 251 that is away from the surface of the photoreceptor belt 17** while keeping therein a yellow toner image and then enters a cycle of image forming for the second color.

Namely, the photoreceptor belt 17 having thereon a yellow toner image formed is again charged by charger 21, then image signals for the second color are inputted in the aforesaid laser writing unit 22, and writing on the surface of the photoreceptor belt 17 is conducted similarly to the aforesaid occasion of the image signals for the first color, and thereby a latent image is formed. The latent image thus formed is developed by developing unit **23*b*** containing magenta toners as the second color. A magenta toner image is formed in the presence of the yellow toner image already formed.

In the same way, a latent image formed by image signals for the third color is developed by developing unit **23*c* containing cyan toners and thus a cyan toner image is formed. Further, a latent image formed by signals corresponding to the fourth color is developed by developing unit 23*d* containing black toners and thus a black toner image is superposed on the surface of the photoreceptor belt 17, resulting in a color toner image formed on the surface of the photoreceptor belt 17**.

DC or further AC bias voltage is applied on each of developing sleeves **231*a*–231*d* of developing units 23*a*–23*d* and reversal development (jumping development) on a non-contact basis is conducted on the photoreceptor belt 17** whose base body is grounded. Incidentally, the non-contact development can employ either mono-component developer or two-component developer. When mono-component developer is used, it is not necessary to provide a toner hopper separately from a developing portion and thereby it is possible to make a unit small. However, on the point of stabilized development, a developing method employing two-component developer is more excellent and is preferable for color reproduction.

A color toner image formed on the surface of the photoreceptor belt 17 as described above is transferred onto an image-transfer material that is fed by sheet feeding roller 27 from sheet feeding cassette 16 and is synchronized with the aforesaid color toner image by timing roller 28. Transfer unit 24 is impressed with high voltage whose polarity is opposite to that of toner and conducts transferring.

The image-transfer material onto which a color toner image has been transferred in the way described above is separated without fail from the photoreceptor belt 17 that changes its direction sharply (small radius of curvature) along driving roller 18, and is transported upward by transport belt 29. Incidentally, the transport belt 29 is provided with suction means 291 which transport the image-transfer material upward while applying suction to it. Then, the image-transfer material is subjected to fixing wherein toners thereon are melted and fixed by fixing roller 30 and then is ejected by sheet delivery roller 31 on the top surface of upper cover 12 that functions also as a delivery tray.

On the other hand, the photoreceptor belt 17 from which a color toner image has been transferred onto an image-transfer material is further transported clockwise, thereby residual toners thereon are removed and cleaned by cleaning means 25 whose cleaning blade 251 is kept in pressure-contact the photoreceptor belt. After completion of cleaning, cleaning blade 251 is kept away from the photoreceptor belt 17 again and enters the following image forming process.

Next, a jam detection sensor will be explained.

In FIG. 1, jam detection sensors $S_1$, $S_2$, $S_3$ and $S_4$ are provided on the transport path for an image-transfer material and they are photosensors each detecting the presence or passage of the image-transfer material, and based on the information of presence of the image-transfer material detected by these jam detection sensors $S_1$–$S_4$, jamming is detected in a jam identifier. The jam identifier detects jamming in a conventional method wherein jamming is identified when an image-transfer material is not detected within a predetermined period of time or when an image-transfer material continues to be detected for a predetermined period of time or more. Jam detection sensors $S_1$–$S_4$ detect whether an image-transfer material is fed from cassette 16 or not, whether an image transfer material is transported surely by timing roller 28 or not, whether toner images are surely separated after transferring or not, and whether an image-transfer material is ejected surely by paper delivery roller 31 or not. Incidentally, arrangement of jam detection sensors is not limited only to the present example, but a jam detection sensor that detects whether an image-transfer material is wound around a fixing roller or not may also be provided. Further, no paper sensor $S_0$ is a sensor that detects existence of an image-transfer material in cassette 16 when the cassette 16 is loaded in the apparatus main frame 10 For these jam detection sensors $S_1$–$S_4$ and no paper sensor $S_0$, not only a reflection type photocoupler exemplified in the present example but also a transmission type photocoupler, or even conventional sensors such as a reed switch of a non-contact type or a microswitch of a contact type may be used.

Next, driving systems for process cartridge 15, for the movement of the process cartridge and for the movement of a cassette will be explained as follows, referring to FIGS. 2–6.

Figure 2:
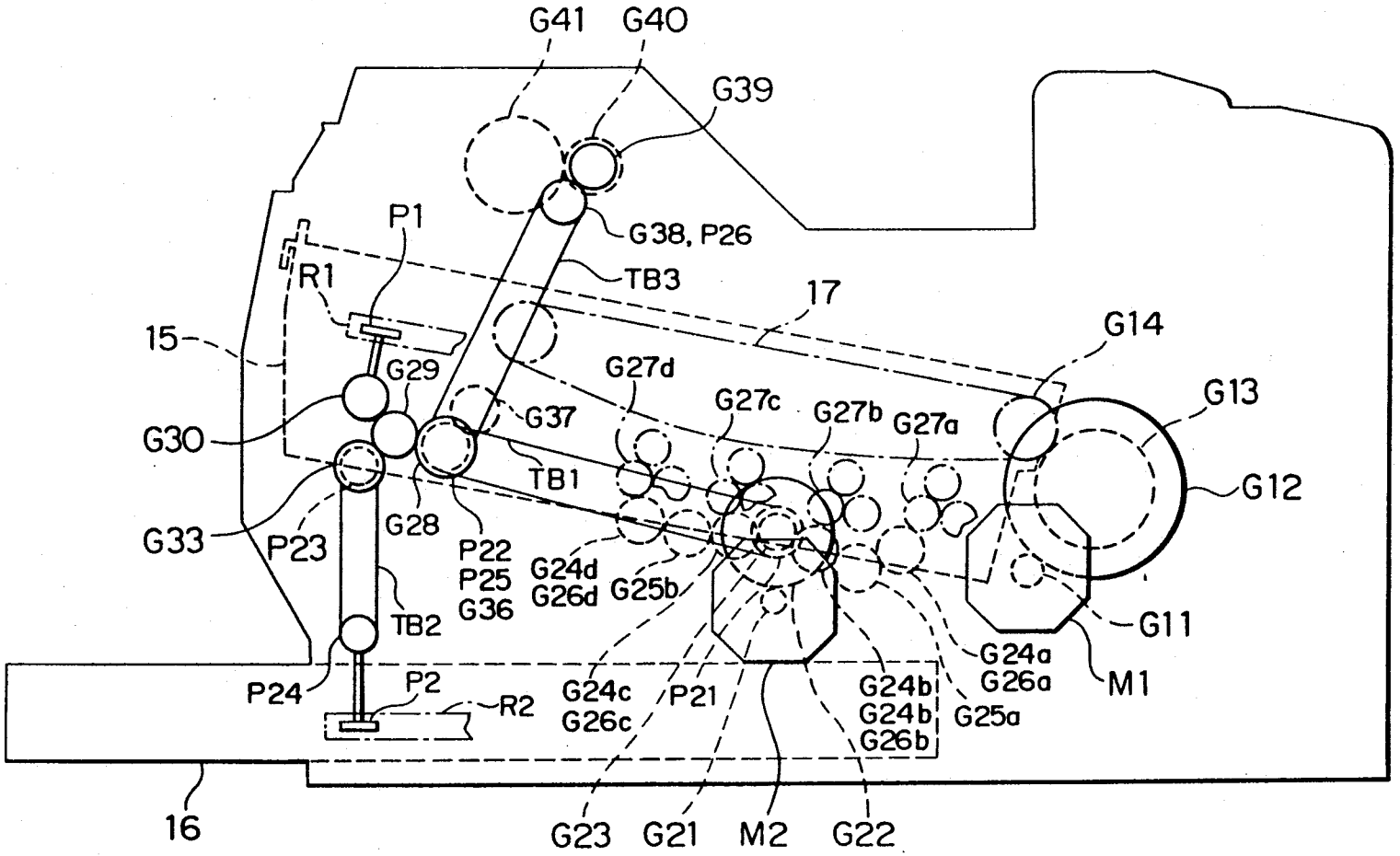
FIG. 2 is a diagram showing from the right side a driving system related to the invention.

FIG. 2 is a diagram showing from the right side the driving systems for process cartridge 15, for the movement of the process cartridge 15 and for the movement of a cassette. Incidentally, the driving system for process cartridge 15, that for the movement of the process cartridge 15 and that for the movement of a cassette all shown in the present example have therein two motors M1 and M2 for driving.

First, the driving system for the photoreceptor belt 17 employs the driving force coming from motor M1. Gear G 12 is arranged so that it may engage with gear G 11 on the shaft of motor M1. Further, when process cartridge 15 is in a position where an image can be formed, driving gear G 14 sharing the same shaft with driving roller 18 which transports the photoreceptor belt 17 engage with gear G 13 that rotates together with the gear G 12. Namely, the rotation of motor M1 is transmitted to the driving gear G 14 via gear G 11, gear G 12 and gear G 13, and thereby is adjusted to an optimum rotating speed, and it further transports the photoreceptor belt 17 by rotating the driving roller 18 counterclockwise in the figure together with the driving gear G 14.

Figure 3:
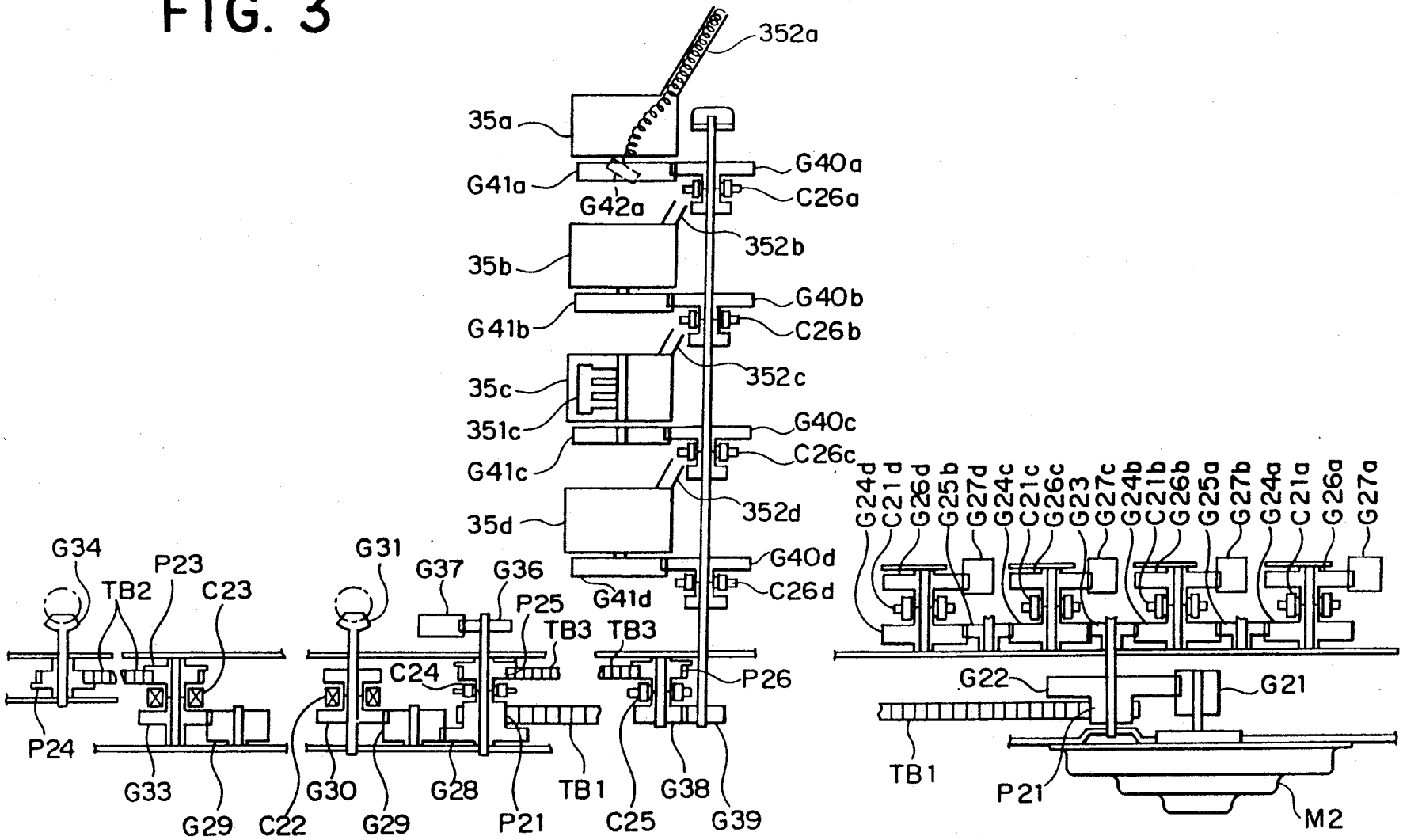
FIG. 3 is a diagram showing from the top a driving system for moving a process cartridge and a cassette.
Figure 4:
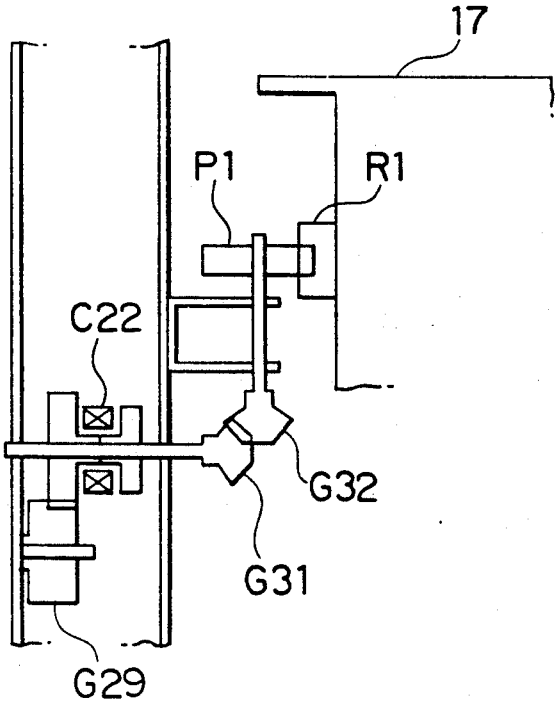
FIG. 4 is a diagram showing the primary portions of the driving system for moving the process cartridge.
Figure 5:
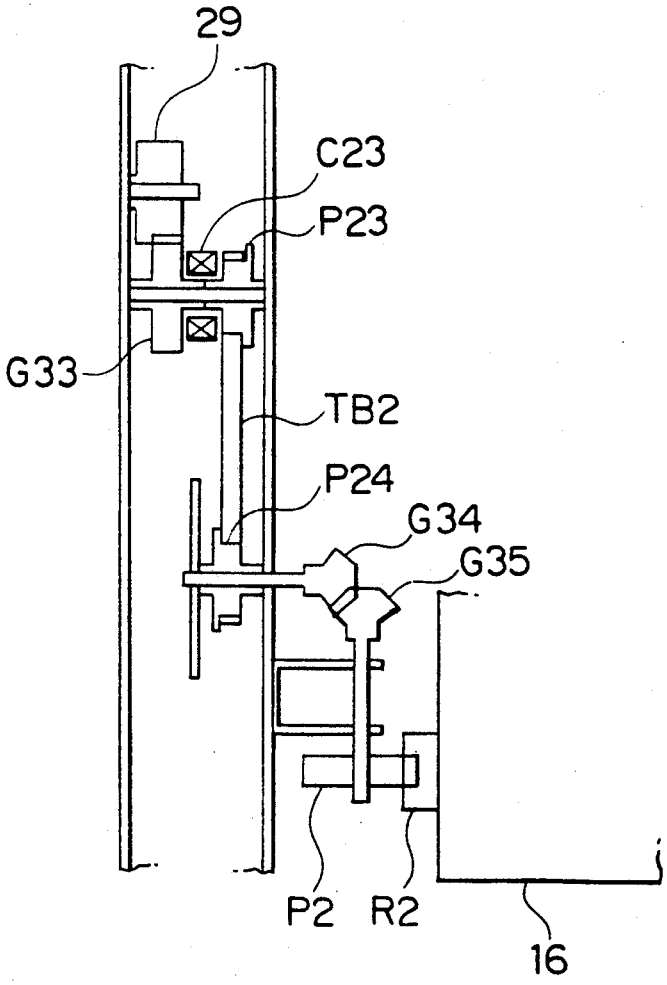
FIG. 5 is a diagram showing the primary portions of the driving system for moving the cassette.

Next, developing units **23*a*–23*d*, waste toner screw 261, toner hopper 35, and driving systems for a process cartridge moving means and a cassette moving means will be explained, referring to FIGS. 2 and 3**.

In this driving system, motor M2 is used. The turning force of the motor M2 is transmitted to gear G 22 through gear G 21 on the shaft of the motor M2. It is further transmitted to gear G 23 provided solidly on the shaft of the gear G 22 and drives the driving system for developing units **23*a*–23*d***.

First, the driving system for the developing units 23a–23d will be explained.

The turning force of the motor M2 transmitted to the gear G 23 is then transmitted to gear G 24b and gear G 24c, and is further transmitted to gear G 24a and gear G 24d through gear G 25a and gear G 25b. In addition to the above, through open type spring clutches C 21a–C 21d (see FIG. 3) for the purpose of transmitting the rotation in only one direction, gears G 26a–G 26d are provided on the same shaft of gears G 24a–G 24d so that, when process cartridge 15 is in a position where an image can be formed, the gears G 26a–G 26d may engage with developing unit driving gears G 27a–G 27d. The turning force transmitted to the developing unit driving gears G 27a–G 27d is further transmitted to developing sleeves 231a–231d and to agitating screws 232a–232d through gears provided on the process cartridge 15, thus it drives developing units. Namely, the rotation of the motor M2 is transmitted to gears G 24b and G 24c through gear G 21, gear G 22 and gear G 23, and is further transmitted to gears G 24a and G 24b through gears G 25a and 25b, and as occasion demands, it is further transmitted to developing unit driving gears G 27a–G 27d through the connection of the clutch, thus it drives developing units 23a–23d. Incidentally, with regard to driving of developing units 23a–23d during image formation, it is preferable that the developing unit corresponding to a color relating to the image formation only is driven and none of developing units 23a–23d is driven while process cartridge 15 and cassette 16 are being moved which will be described layer. For this purpose, it is preferable that cams (not shown) having claws touching ratchets (not shown) of clutches C 21a–C 21d are given phase differences and five selective positions including a position where none of clutches is connected are provided to be controlled by a step motor (not shown). For example, adjoining claws among four claws of cams corresponding to clutches are given a phase difference of 72° on the same shaft, and a step motor is rotated by 72° each time, thus, developing units can be controlled so that only one of them is driven or none of them is driven.

Next, a process cartridge moving means will be explained.

The turning force of the motor M2 transmitted to gear G 22 is transmitted to pulley P22 through pulley P21 that rotates together with gear G 22 and timing belt TB1 and is further transmitted to gear G 29 engaging with gear G 28 that rotates together with pulley P 22. Further, the turning force of the motor M2 transmitted to the gear G 29 is transmitted to gear G 30 engaging with the gear G 29. That turning force, as occasion demands, is transmitted to gear 31 through electromagnetic clutch C 22. The gear G 31 and gear G 32 are intersecting axis gears, and the turning force transmitted to the gear G 31 is transmitted to pinion P1.(See FIG. 4.) The pinion P1 is capable of engaging with rack R1 provided on the side of process cartridge 15, and the process cartridge 15 is moved from side to side by the rotation of the pinion P1 and the slide of the rack R2. With regard to the movement of the process cartridge 15, it will be explained in detail later.

Next, a cassette moving means will be explained.

The turning force of the motor M2 transmitted to gear G 29 is transmitted to gear G 33 engaging with the gear G 29. Its turning force, when necessary, is transmitted to the pulley 22 through electromagnetic clutch C 23, transmitted to pulley 24 through timing belt TB2, and further transmitted to gear G 34 that rotates together with the pulley 24. The gear G 34 and gear G 35 are intersecting axis gears, and the turning force transmitted to the gear G 34 is transmitted to pinion P2.(See FIG. 5.) The pinion P2 is capable of engaging with rack R2 provided on the side of cassette 16, and the cassette 16 is moved from side to side by the rotation of the pinion P2 and the slide of the rack R2. The movement of the cassette 16 will also be explained in detail later.

Next, a driving system for waste toner collection will be explained.

The turning force of motor M2 transmitted to pulley P 22, when necessary, is transmitted to pulley P 25 through open type spring clutch C 24, and drives the driving system for waste toner screw 261.

With regard to the driving system for waste toner screw 261, gear G 36 that rotates together with the pulley P 25 engages with waste toner screw driving gear G 37 provided on the side of process cartridge 15, and the turning force transmitted to the pulley P 25 drives the waste toner screw 261. The waste toner screw 261 transports residual toners removed by cleaning means 25 from the photoreceptor belt 17 to toner collection box 26 via toner collection tube 262 having therein a built-in coil spring that rotates.

Next, the driving system for toner hoppers 35a–35d will be explained.

The turning force of motor M2 transmitted to pulley P 25 is transmitted to pulley P 26 through timing belt TB3, and if necessary, to gear G 38 through spring clutch C 25, and further transmitted to gear G 39 engaging with the gear G 38. When necessary, spring clutches C 26a–C 26d are caused to engage and thereby gears G 41a–G 41d rotate, meshing with gears G 40a–G 40d which rotate together with the gear G 39. Then, toner hopper agitating members 351a–351d rotate together with gears G 41a–G 41d and agitate replenishment toners in toner hoppers 35a–35d, and concurrently with that, replenishment toner screws 352a–352d provided to be coaxial gears G 42a–G 42d meshing with gears G 41a–G 41d with gears G 42a–G 42d meshing with gears G 41a–G 41d rotate and transport replenishment toners to developing units 23a–23d in process cartridge 15. Incidentally, toner hoppers 35a–35d are driven corresponding to driving of the aforesaid developing units 23a–23d. Namely, when a developing unit corresponding to a color for image formation is driven, a toner hopper containing toners of the same color only can be driven. For controlling this driving, spring clutches C 26a–C 26d are used, and the drive can be controlled by means of step motors and cams (both are not shown) as in the case of controlling the drive for developing units.

Incidentally, in the present example, two motors M1 and M2 are used for the driving system of photoreceptor belt 17 and the driving system for developing units 23a–23d, waste toner screws 261, toner hoppers 35, process cartridge moving means and for cassette moving means. However, it is a matter of course that only one motor is used for all driving, or an exclusive motor is used for each of process cartridge moving means and cassette moving means.

Next, a movement of process cartridge 15 will be explained, referring to FIG. 6 that is a sectional view taken on line A—A in FIG. 1 and FIGS. 7-a–7-c wherein movements of process cartridge 15 are shown explanatorily.

On the side of the process cartridge 15, there are provided protruded member 36 and rack R1 both for the movement, and there are further provided driving gear G 14, developing unit driving gears G 27*a*–G 27*d*, and waste toner screw driving gear G 37 all of which are for image formation. Incidentally, a roll or the like may be provided on the protruded member 36 for easy movement.

In the process cartridge-containing chamber in apparatus main frame 10, on the other hand, there are provided guide member 37 for guiding process cartridge 15 for insertion and taking out (in the present example, guide member 37, when being inserted with the protruded member 36 of process cartridge 15, guides the process cartridge 15 by hanging it), gear G 13, gears G 26*a*–26*d* and gear G 36 all corresponding respectively to driving gear G 14 for process cartridge 15, developing unit driving gears G 27*a*–G 27*d* and waste toner screw driving gear G 34 Further, pinion P1 is provided so that it may engage with rack R1 located on process cartridge 15. In addition to the above, the guide member 37 is provided with the first and second microswitches MS1 and MS2. These first and second microswitches MS1 and MS2 are detecting means for detecting the position of the process cartridge 15. The first and second microswitches MS1 and MS2 detect the first position where driving gear 14 provided on the process cartridge 15, developing unit driving gears G 27*a*–G 27*d* and waste toner screw driving gear G 37 engage respectively with gear G 13, gears G 26*a*–G 26*d* and gear G 36, and thereby an image can be formed, and the second position that is farther from the transfer unit 24 than the first position, namely the position that is behind the first position in the direction for inserting the process cartridge 15, and send the position information to the control unit. It is however preferable that the center of gravity of the process cartridge 15 is not out of the apparatus main frame 10 in the second position. The reason for this is that when the center of gravity of the process cartridge 15 is out of the apparatus main frame, engagement of rack R1 and pinion P1 is deteriorated, resulting in difficult taking out and insertion of the process cartridge 15. Position detecting sensors for detecting the first and second positions are not limited only to microswitches, but various kinds of conventional sensors employing photoelectric switches or magnetic switches may be used. Further, the first and second microswitches MS1 and MS2 do not need to be provided on guide member 37..They can be provided also on the apparatus main frame 10 because detection of the first and second positions is all that needs to be done by the microswitches MS1 and MS2.

Figure 7A:
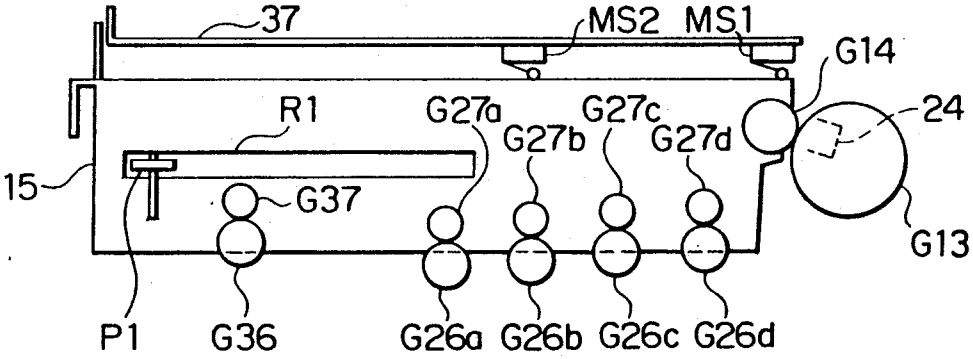
FIGS. 7(*a*)–(*c*) is an illustrating diagram showing the movement of the process cartridge on a typical basis.
Figure 7B:
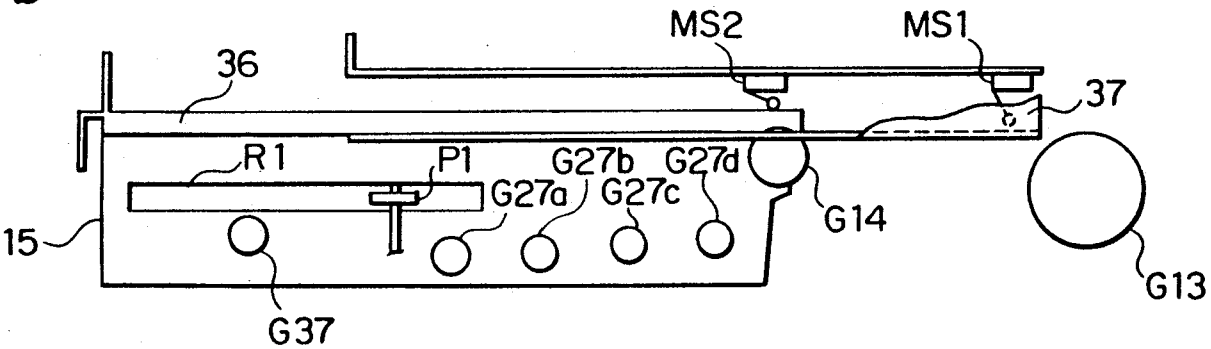
Figure 7C:
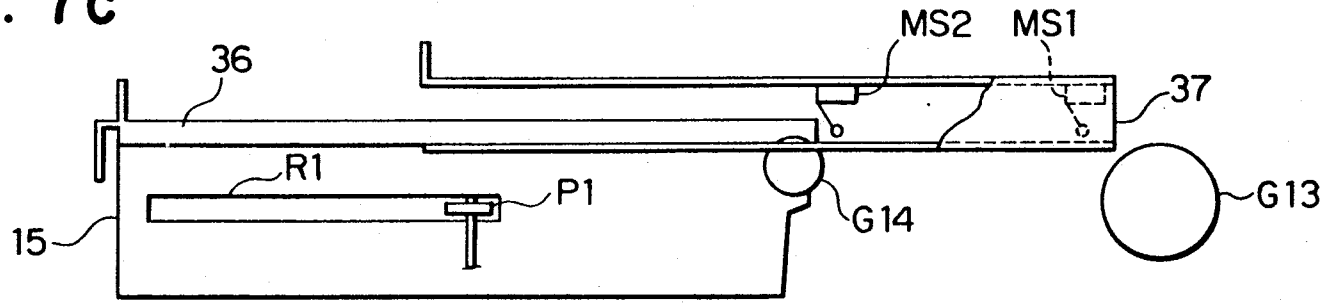
Figure 8A:
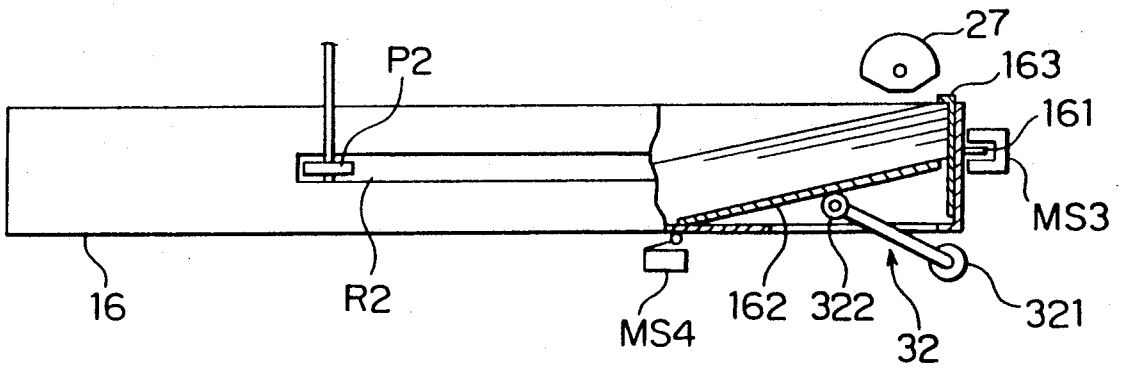
FIGS. 8(*a*)–(*c*) represent illustrating diagrams showing typically the movement of a cassette.
Figure 8B:
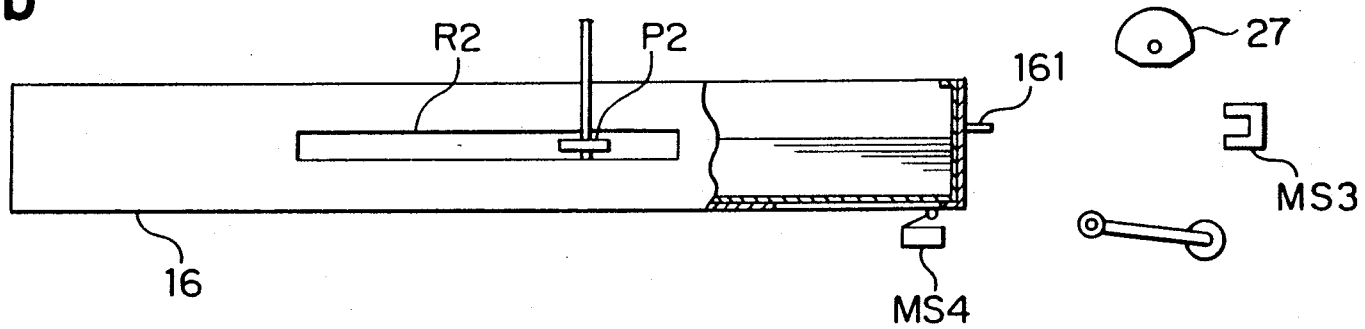
Figure 8C:
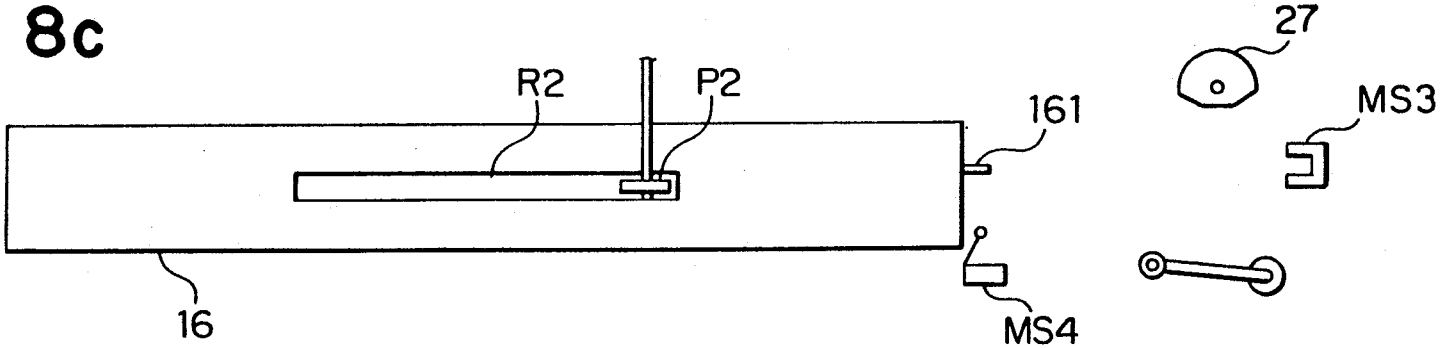
Figure 9A:
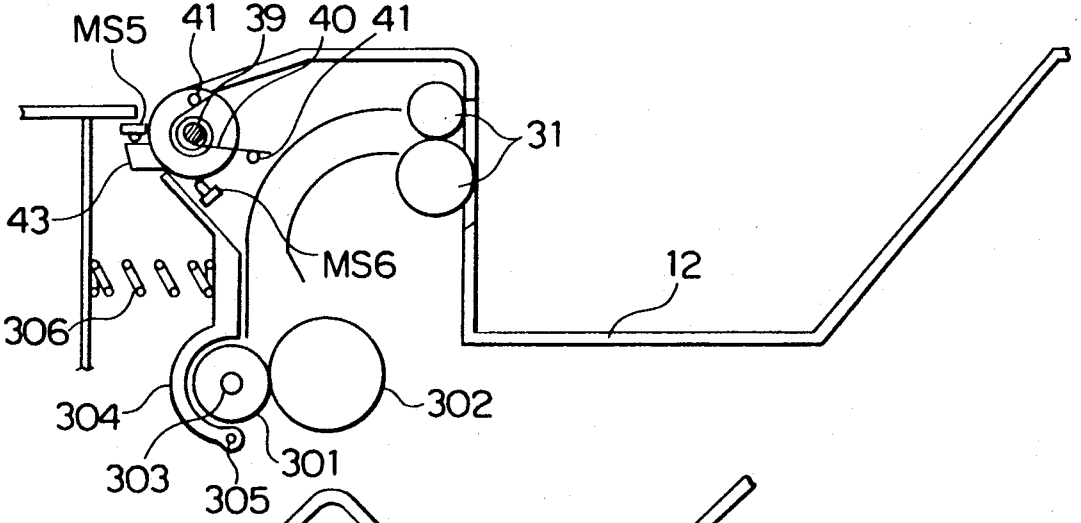
FIGS. 9 (*a*) and (*b*) represent diagrams showing an opening mechanism for an upper cover.
Figure 9B:
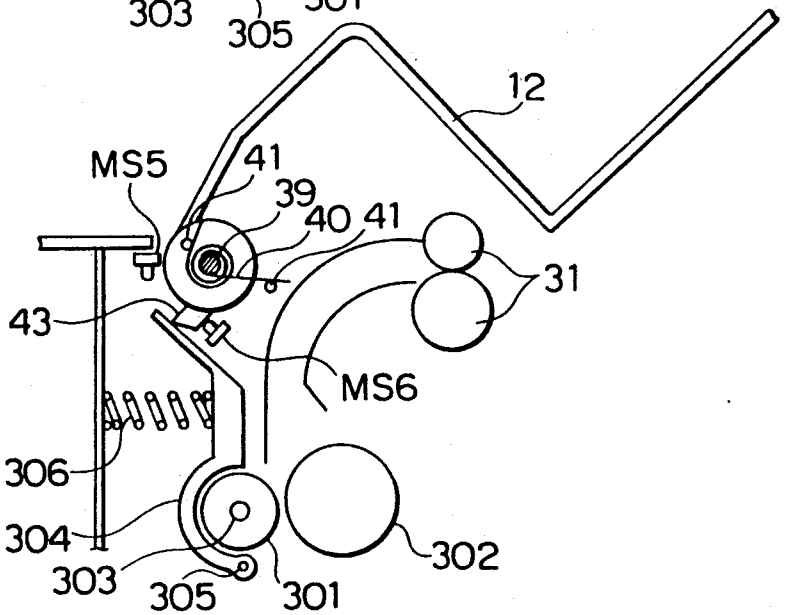

First, when taking out the process cartridge 15, it is in the first position as shown in FIGS. 7–9. Namely, the photoreceptor belt 17 on the driving roller 18 is keeping a desirable distance from the transfer unit 24 (pressure-contact force when a transfer member is a transfer drum), and driving gear G 14 provided on process cartridge 15, developing unit driving gears G 27A–27D and waste toner screw driving gear G 37 are engaging respectively with gear G 13, gears G 26*a*–26*d* and gear G 36 each driving those respectively provided on the apparatus main frame 10, which represents the situation wherein an image may be formed on the optimum conditions. Further, rack R1 provided on the process cartridge 15 is engaging with pinion P1 provided on the apparatus main frame 10.

Under the aforementioned conditions, a control unit which will be described later sends signals for moving the process cartridge to a process cartridge moving means, namely, the control unit sends signals to motor M2 that is a driving portion for the process cartridge moving means and to electromagnetic clutch C 22, thus, causes pinion P1 to rotate for moving the process cartridge 15 from the first position to the second position, and thereby the process cartridge 15 moves toward the second position along guide member 37. (See FIG. 7-*b*.)

Then, when the process cartridge 15 moves as shown in FIG. 7-*c*, the second microswitch MS2 detects that the process cartridge 15 has reached the second position, and sends that signal to the control unit. Upon receiving the signal, the control unit releases the electromagnetic clutch C 22 to stop the moving process cartridge 15, and causes the motor M2 to stop running if unnecessary. Namely, the process cartridge 15 stops at the second position under the condition that rack R1 is engaging with pinion P1, which means a retreat from the first position to the second position. Under this condition, namely the condition wherein the process cartridge 15 is in the second position, it is possible to clear a jam. Further in second position, the process cartridge 15 is detachable. Therefore, it is possible to take it out from the apparatus main frame 10 for replacement just by pulling it out slightly from the second position. Incidentally, the front cover 14 is constructed so that it does not interrupt the movement of the process cartridge 15 (to be described later).

On the contrary, when inserting the process cartridge 15 into the apparatus main frame 10 after replacement, protrusion 36 on the process cartridge is caused to move along the guide member 37 provided in the chamber for housing the process cartridge 15, rack R1 and pinion P1 are caused to engage each other, and the process cartridge 15 is inserted until it arrives at the second position (FIG. 7-*c*). Namely, the process cartridge 15 is in the second position (which is a state after clearing jam).

For the purpose of moving the process cartridge 15 from the second position to the first position where an image can be formed, when the process cartridge 15 located at the second position is further inserted or when movement signals are inputted from a control unit which will be explained later, the signals are sent to motor M2 and electromagnetic clutch C 22, thus pinion P1 is rotated (in the direction opposite to that for taking out) for the movement of the process cartridge 15 from the second position to the first position, and the process cartridge 15 moves toward the first position along the guide member 37 (FIG. 7-*b*).

After the movement of the process cartridge 15, the first microswitch MS1 detects that the process cartridge 15 has arrived at the first position as shown in FIG. 7-*a*, and it sends that signals to the control unit. Upon receiving the signals, the control unit releases the electromagnetic clutch C 22 to stop the process cartridge 15 at the first position, and further causes the motor M2 to stop running if unnecessary. Namely, the process cartridge 15 stops at the first position and driving gear G 14 provided on the process cartridge 15, developing unit driving gears G 27*a*–G 27*d* and waste toner screw driving gear G 37 engage respectively with gear G 13, gears G 26*a*–G 26*d* and gear G 36 to generate the state wherein an image can be formed. In this case, toner replenishing inlets 38*a*–38*d* of developing units 23*a*–23*d* in the process cartridge 15 are automatically connected respectively to toner transport tubes 353*a*–353*d* of corresponding toner hoppers 35*a*–35*d* to create the state wherein toners can be replenished.

When the process cartridge 15 moves, the front cover 14 is urged by a spring in the direction for closing. Therefore, it does not interrupt the movement of the process cartridge 15. Namely, the front cover 14 is pushed by the movement of the process cartridge 15 and thereby is opened. Or, there may be another way in which the front cover 14 urged by a spring is held by a solenoid, and signals are sent to the solenoid for releasing the holding concurrently with generation of signals from the control unit for moving the process cartridge 15, and thus the front cover may be opened by the restoring force of the spring. Further, when opening the front cover by means of a motor and a gear, it is possible to employ a method wherein the front cover 14 opens when the process cartridge 15 starts moving from the first position to the second position, and the front cover 14 closes automatically when the first microswitch MS1 detects that the process cartridge 15 has moved to the first position when it moves from the second position to the first position.

Next, explanation will be made referring to FIGS. 8-*a*–8-*c* showing explanatorily the movement of cassette 16.

Cassette 16 is provided on its side with rack R2 for the movement and with protrusion 161 on its front for insertion, and further is provided inside thereof with rotatable bottom plate 162 on which image-transfer materials are stacked and with slidable separation claw 163.

On the other hand, in the cassette-housing chamber of the apparatus main frame 10, there are provided sheet feeding roller 27, pinion P2 for moving cassette 16, push-up lever 32 for pushing up the bottom plate 162, photoelectric switch MS3 composed of a photocoupler, and microswitch MS4.

The push-up lever 32 is supported rotatably in push-up mechanism 321 provided in the apparatus main frame 10 and is provided with a roll 322 on its tip. The push-up mechanism can employ a conventional method such as a spring, a principle of the action of levers, and a motor and it can be housed in the cassette 16 together with the push-up lever 32.

Photoelectric switch MS3 and microswitch MS4 represent a detection means for detecting the position of cassette 16. The photoelectric switch MS3 and the microswitch MS4 respectively detect the first position where the uppermost surface of image-transfer materials in the cassette 16 is caused by the aforementioned push-up lever 32 to press the separation claw 163 for feeding sheets, and the second position which is farther than the first position in the direction opposite to that for insertion of the cassette 16, and position signals obtained from the detection are sent to a control unit. It is preferable that the center of gravity of the cassette 16 is within the apparatus main frame 10 as in the case of the process cartridge 15. Position detecting sensors for detecting the first and second positions are not limited to those in the present example, but various kinds of conventional ones employing a microswitch, a photoelectric switch or a magnetic switch may also be used.

First, when taking out cassette 16, it is in the first position as shown in FIG. 8-*a* where a image-transfer material can be fed properly by the sheet feeding roller 27. Rack R2 and pinion P2 are engaging each other.

Under the aforementioned condition, a control unit which will be explained later sends signals for moving a cassette to a cassette moving means, namely, the control unit sends signals to motor M2 and electromagnetic clutch C 23 which are the driving portions for the cassette moving means to rotate the pinion P2 for the purpose of moving the cassette 16 from the first position to the second position. In this case, the push-up lever 32 retreats toward the lower side of the movement path of cassette 16 so that the movement of cassette 16 may not be interrupted. (See FIG. 8-*b*.)

When cassette 16 moves as shown in FIG. 8-*c*, microswitch MS4 detects that the cassette 16 has moved to the second position, and send that signal to a control unit. Upon receiving the signal, the control unit stops the moving cassette 16 by releasing the electromagnetic clutch C 23 and causes motor M2 to stop if unnecessary. Namely, the cassette 16 stops at the second position under the condition wherein rack R2 engages with pinion P2, which means a retreat of the cassette 16 from the first position to the second position. At this second position, the cassette 16 is detachable, and it can be taken out by taking out slightly from the apparatus main frame 10 on occasion of jam clearing, replacement of cassette 16 and supplying of image-transfer materials in cassette 16.

On the contrary, when inserting the cassette 16 into the apparatus main frame 10 after the completion of jam clearing, replacement of cassette 16 or supplying image-transfer materials in cassette 16, the cassette 16 is inserted along the inside of the cassette-housing chamber or along a guide member (not shown), rack R2 and pinion P2 are caused to engage each other, and the cassette 16 is further inserted until it reaches the second position (FIG. 8-*c*).

When the cassette 16 located at the second position is further inserted for the purpose of moving the cassette 16 located at the second position to the first position where sheet feeding is possible, or when movement signals are inputted from a control unit which will be explained later, the signals are sent to the motor M2 and electromagnetic clutch C 23, and the pinion P2 is rotated (in the direction opposite to that for taking out) for the purpose of moving the cassette 16 from the second position to the first position, thus the cassette 16 is moved toward the first position along guide member 37 (FIG. 8-*b*).

Further, when the cassette 16 moves, photoelectric switch MS3 detects, owing to the protrusion 161, that the cassette 16 has moved to the first position as shown in FIG. 8-*a*, and sends that signal to a control unit. Upon receiving the signal, the control unit stops the cassette 16 at the first position by releasing the electromagnetic clutch C 23, and stops also the motor M2 if unnecessary. Namely, the cassette 16 stops at the first position, and push-up mechanism 321 rotates push up lever 32 clockwise to cause the roll 322 to push up the bottom plate 162 in the cassette 16 so that the uppermost surface of image transfer materials stacked on the bottom plate 162 may press separation claw 163 for generating the state where sheet-feeding is possible by means of sheet-feeding roller 27 that is a woodruff roller.

Next, a means of opening the upper cover will be explained referring to FIG. 9.

The upper cover 12 is supported rotatably by upper cover shaft 39. The upper cover 12 is spring-urged to open, or to turn counterclockwise in the same figure by means of coil spring 40 wound round the upper cover shaft 39 and two pins 41 whose one end is attached on the apparatus main frame 10 and the other end thereof is attached on the upper cover. The upper cover is provided with microswitches MS5 and MS6 detecting respectively that the upper cover is closed and that it is opened. In addition, a holding member (not shown) that is capable of holding the upper cover 12 in the closed position is provided. When the upper cover 12 is closed in the image forming process, the upper cover 12 serves also as a delivery tray for image-transfer materials which have been finished in terms of image-transfer and ejected by delivery roller 31 (FIG. 9-*a*).

In the case of jam clearing, when an unillustrated holding member discontinues holding the upper cover 12, the spring-urged upper cover 12 is opened by the urging force of the spring (FIG. 9-*b*), the microswitch MS6 detects that the upper cover 12 has been opened, and sends that signal of opening to a control unit. On the contrary, when an operator closes the upper cover 12 after jam clearing has been finished, the microswitch MS5 detects that the upper cover 12 has been closed and sends that signal of closing to the control unit. Incidentally, the upper cover opening means is not limited to those in the present example, but a member capable of holding on upper cover shaft 39 may be provided. Further, these holding members may be replaced by solenoids. Further, it is possible to employ a method wherein upper cover shaft 39 is provided with a gear and with a motor which engages with the gear, and the motor is rotated by the command for opening coming from operation panel 11, thus the upper cover 12 is opened. In this case, it is possible to create the system wherein when set signals are inputted in the control unit, the motor rotates in the reverse direction to close the upper cover 12. Further, in the present example, an explanation is given using an image forming apparatus wherein upper cover 12 is located at the upper portion of the process cartridge 15, but the invention is not limited only to this. Namely, in the case of an image forming apparatus of a clamshell type, it is possible to provide an opening means on the upper half in place of the opening means of the upper cover 12 in the present example. Further, detecting means for detecting opening or closing of the upper cover 12 are not limited to microswitches, but they may be conventional switches such as photoelectric switches or magnetic switches. Further, it is not necessary to provide two switches. Either one of them is enough.

Next, fixing roller pressure-contact and releasing means will be explained, referring to FIGS. 9-*a* and 9-*b*.

In the present example, aforesaid opening and closing of the upper cover 12 are utilized for pressure-contact and releasing of fixing roller 30, Namely, there is provided protrusion 43 that rotates together with the upper cover 12 in the vicinity of the upper cover shaft 39 and serves as a cam. On the other hand, fixing roller 30 is composed of pressure roller 301 and heating roller 302, and an unillustrated separating member and a cleaning member are provided around the heating roller 302 which is rotated clockwise by an unillustrated driving system. The pressure roller 301 can rotate counterclockwise being driven by the heating roller 302 and its pressure roller shaft 303 is supported rotatably by pressure releasing member 304. The pressure releasing member 304 is supported on its one end rotatably in the apparatus main frame 10 by means of pressure releasing shaft 305 and is urged by spring 306 clockwise. Therefore, fixing roller 30 in the image forming process can melt and fix toner images on an image-transfer material and transport the image-transfer material to delivery roller 31, with pressure roller 301 pressing the heating roller 302 and with the heating roller 302 being heated by an unillustrated heating means and rotated.

When the protrusion 43 rotates counterclockwise following the opening of the upper cover 12, owing to the pressure releasing mechanism, the pressure releasing member 304 rotates counterclockwise around the pressure releasing shaft 305, thereby pressure roller 301 supported rotatably on the pressure releasing member 304 is released from its pressure-contact on the heating roller 302. Thus, a clearance is generated between the pressure roller 301 that is pressure-released fixing roller 30 and the heating roller 302. Therefore, it is possible to remove easily a jammed paper in a fixing unit.

On the contrary, for the pressure-contact of the fixing roller 30, the protrusion 43 rotates clockwise when the upper cover 12 opens, and then the pressure roller 301 is caused to be in pressure-contact on the heating roller 302 because the pressure releasing member 304 is urged by spring 306 to rotate clockwise around the pressure releasing shaft 305. Therefore, a simple mechanism can cause the fixing roller 30 to be in pressure-contact or to be released from it.

Incidentally, though the pressure roller 301 is moved to release the pressure-contact of the fixing roller 30 in the present example, it is naturally possible to move the heating roller 302 for releasing the pressure-contact of the fixing roller 30. Further, the pressure-contact of the fixing roller 30 can be released directly by the signal of a control unit in the usage of a motor and gears or solenoids, though the pressure releasing mechanism in the present example employs a cam in the upper cover 12.

Figure 10:
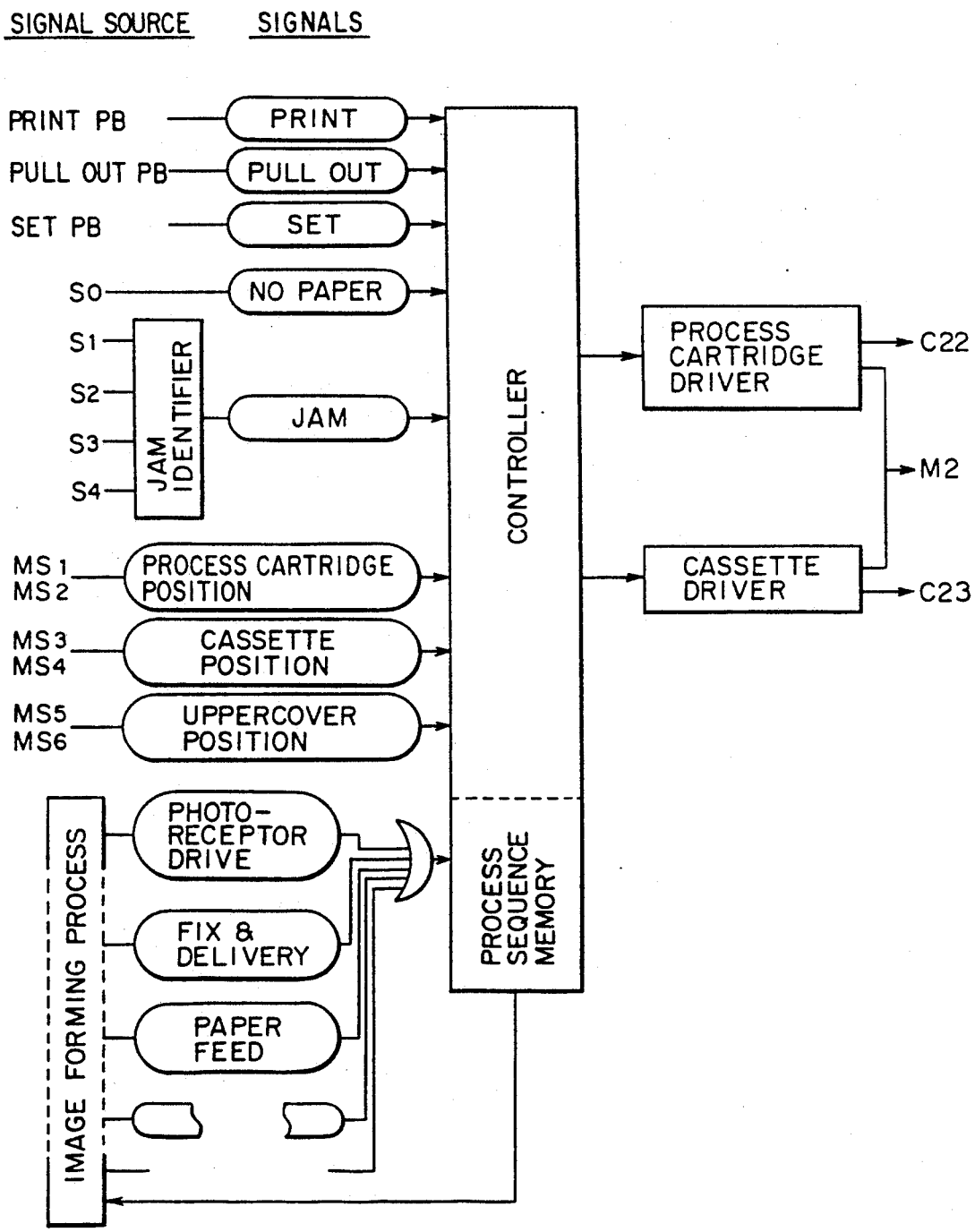
FIG. 10 is a diagram showing a control system for moving a process cartridge and a cassette.
Figure 11:
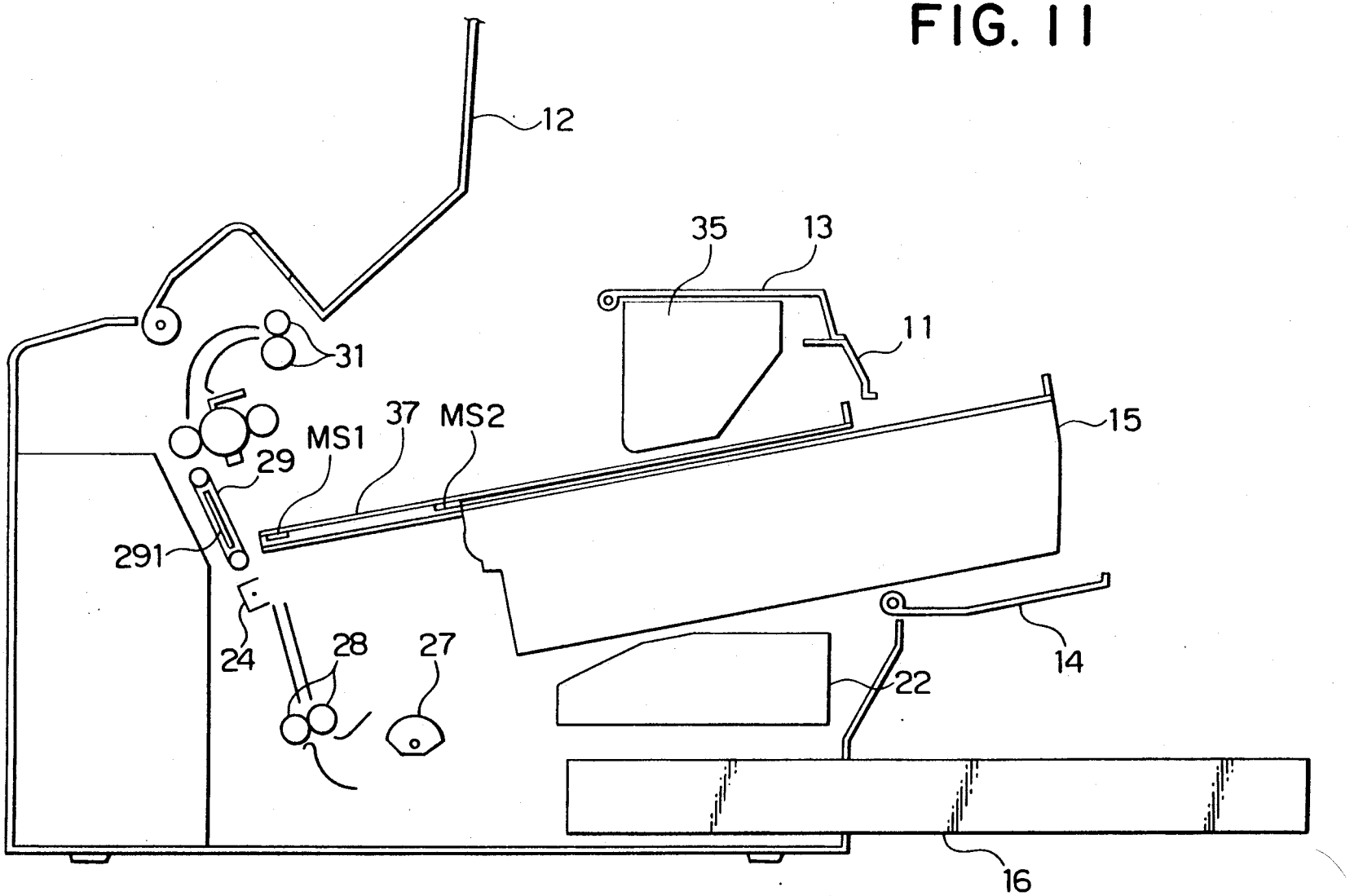
FIG. 11 is a diagram showing from the left side a color printer wherein a process cartridge and a cassette are in the second position.

The movement control of process cartridge 15 and cassette 16 and opening means for the upper cover 12 explained above are shown in FIG. 10. Namely, when an operator opens the upper cover 12, microswitch MS6 generates opening signals. The control unit in which the aforesaid opening signals have been inputted generates process cartridge moving signals and cassette moving signals. A process cartridge moving means which has received the process cartridge moving signals from the control unit controls a process cartridge movement driving system for the purpose of moving the process cartridge 15 from the first position to the second position, and then the process cartridge moving means stops the process cartridge movement driving system after obtaining position detection signals which represent that the process cartridge 15 has moved to the second position. On the other hand, the cassette moving means which has received cassette moving signals from the control unit also moves the cassette 16 from the first position to the second position. In other words, it is possible to cause process cartridge 15 and cassette 16 to retreat automatically to the second position only by opening the upper cover 12 as shown in FIG. 11. Therefore, it is possible to identify and remove a jammed paper easily. When an operator closes the upper cover 12 after jam clearance, the control unit generates, after receiving signals representing that the upper cover 12 has been closed, the movement signals for moving the process cartridge or the cassette to its first position, when it is in the second position, to the process cartridge moving means or to the cassette moving means. Namely, it is possible to cause process cartridge 15 and cassette 16 both in the second position to be inserted automatically only by closing the upper cover 12 after jam clearance, which not only causes an operator to be free from complicated work but also causes process cartridge 15 and cassette 16 to be set at the optimum positions.

Further, jam signals obtained from jam detection sensors $S_1$–$S_4$ may also be utilized for moving the process cartridge 15 and cassette 16. Namely, signals for existence of image-transfer materials generated from jam detection sensors $S_1$–$S_4$ are examined in a jam judgment unit whether they represent jamming or not, and when judged to be jamming, the jam judgment unit generates signals representing jam occurrence and its location to the control unit. Thereupon, the control unit stops the driving units for image forming a photoreceptor belt driving unit, a developing unit driving unit, and a fixing unit driving unit, and concurrently with that, indicates on operation panel 11 the occurrence of jamming. Upon confirmation of the indication, an operator opens the upper cover 12 by moving a holding member for the upper cover 12. Microswitch MS6 detects that the upper cover 12 has been opened and sends signals of that opening to the control unit. In this case, if the control unit moves selectively and automatically the process cartridge 15 or cassette 16 whichever necessary to be moved for jam clearing in a way that the control unit sends movement signals to the moving means having a mark of a circle "○" in FIG. 12 depending on the location of jam occurrence as shown in the same figure (e.g., to send movement signals to a cassette moving means in case of occurrence of jamming at the position of sheet feeding ($S_1$), to a process cartridge moving means and to a cassette moving means in case of occurrence at timing ($S_2$), to a process cartridge moving means in case of occurrence at the position for transferring ($S_3$), and to send nothing in case of occurrence at the position of sheet delivery ($S_4$)), an operator can ascertain the location of a jammed sheet and clear it easily only by opening the upper cover 12 without considering anything.

Further, in addition, to the aforesaid opening of the upper cover 12, an operator can move process cartridge 15 and cassette 16 by pushing, at his free will, a take-out button provided on an operation panel for the purpose of moving the process cartridge 15 and cassette 16 in the case of replacement thereof. Namely, when the take-out button on the operation panel 11, take-out signals are inputted in the control unit, and when print signals from a print button on an operation portion and image forming process signals such as photoreceptor belt driving signals, fixing and sheet delivery driving signals and sheet feeding driving signals representing that image forming processes such as a photoreceptor belt driving unit, fixing and sheet delivery driving units and a sheet feeding unit are in operation are not being generated, the control unit transmits respectively process cartridge movement signals and cassette movement signals to a process cartridge moving means and a cassette moving means, and thus the control unit can move the process cartridge 15 and the cassette 16 from the first position to the second position. On the contrary, even when moving the process cartridge 15 and the cassette 16 from the second position to the first position, a set button provided on the operation panel 11 is pressed in addition to the foregoing, and when the process cartridge 15 or the cassette 16 is at the second position, the control unit transmits to the process cartridge moving means or to the cassette moving means the movement signals for moving the process cartridge 15 or the cassette 16 each positioned at the second position to the first position, thus the control unit moves the process cartridge 15 or the cassette 16 to the first position. Namely, after the set button on the operation panel is pressed, the process cartridge 15 and cassette 16 are at the first position, and an image forming apparatus can be set to the condition wherein the apparatus can form images. Incidentally, with regard to a take-out button and a set button provided on operation panel 11 respectively for moving a process cartridge and moving a cassette, they can either be provided so that the process cartridge 15 and the cassette 16 are moved simultaneously or be provided independently so that the process cartridge 15 and the cassette 16 are moved independently. Further, on the occasion other than occurrence of jamming, it is possible to employ a technology wherein when no paper sensor $S_0$ detects no image-transfer material in cassette 16, the control unit, after receiving no paper signals, generates cassette moving signals and thereby moves the cassette 16 from the first position to the second position.

As an image forming process in the present example, there has been explained an image forming method wherein a color toner image is formed on a photoreceptor belt and then it is transferred onto an image-transfer material at a stretch. However, it is also possible to employ a color image forming method wherein toner images are transferred by superposing them onto an image-transfer material placed on a photoreceptor drum. Further, the invention can be applied to a conventional monochromatic printer employing a monochromatic process. Though a non-contact developing method has been explained as a developing method, the invention is not limited to the non-contact developing method but it may also be applied to a developing method of a contact type. Further, driving systems explained in the present example represent only an example, and the invention is not naturally limited only to a combination of gears, clutches and belts. Further, the invention is not limited only to protrusions, guide members, racks and pinions for the movement of a process cartridge but it can also employ a method wherein a process cartridge is placed on a tray and the tray is moved between the first position and the second position, for example.

Figure 13:
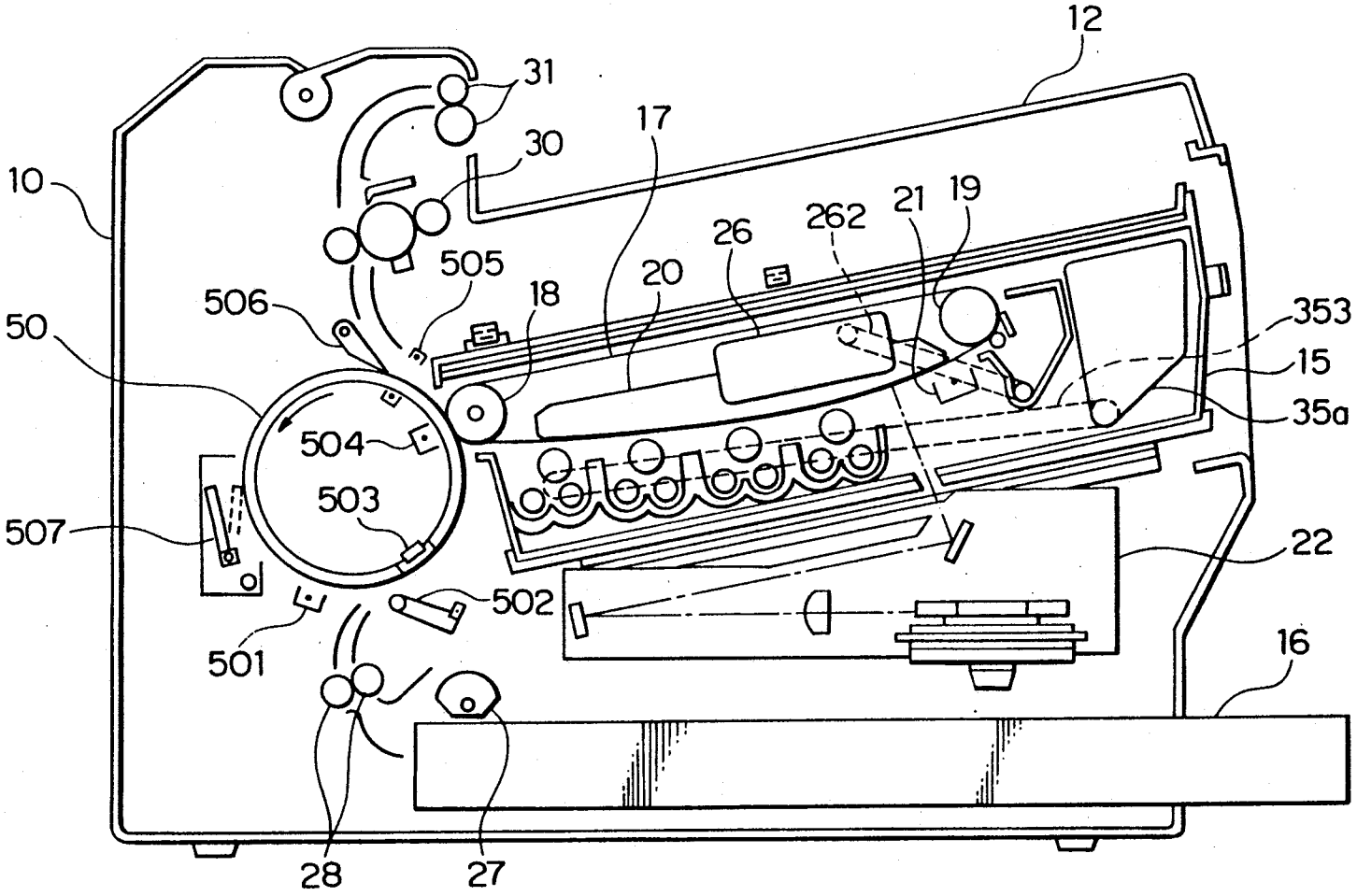
FIG. 13 represents a primary sectional view of an image forming apparatus of a transfer drum type to which the invention is applied.

FIG. 13 shows, as another example, an image forming apparatus of a transfer drum type to which the invention is applied. With regard to a portion of process cartridge 15, it is almost the same as that in the preceding example, but toner hopper 35*a* is incorporated in process cartridge 15 to be a unit. In the image forming apparatus of a transfer drum type, transfer drum 50 is kept to be contact with a transfer portion on the photoreceptor belt 17, and the transfer drum 50 rotates counterclockwise synchronizing with the photoreceptor belt 17. Around the peripheral surface of the transfer drum 50, an image-transfer material is wound, and each toner image having its own color formed on the photoreceptor 17 is transferred onto the wound image-transfer material successively so that the toner images of different colors thus transferred are superposed on the wound image transfer material, and after that, the wound image-transfer material is separated from the transfer drum 50 and is ejected onto the top of the apparatus main frame 10 after being fixed.

Around the transfer drum 50, there are provided charging unit 501 which causes an image-transfer material to be attracted electrostatically and winding member 502 for winding mechanically the image-transfer material round the transfer drum 50. The winding member 502 is equipped, on its tip, with a roller and it contacts the transfer drum 50 only when the image-transfer material starts being wound round the transfer drum 50. Further, on the peripheral surface of the transfer drum 50, there is equipped gripper 503 which functions to hold the leading edge of an image-transfer material transported synchronously. Transfer unit 504 transfers toner images on the photoreceptor belt 17 electrostatically onto an image-transfer material. Both separation neutralizing electrode 505 and separation claw 506 separate the image-transfer material after transferring from the transfer drum 50. Cleaner 507 capable of contacting the transfer drum 50 and being away therefrom removes residual toners remaining on the transfer drum 50 after separation of the image-transfer material.

An image-transfer material fed out from cassette 16 advanced, keeping synchronization, toward transfer drum 50 charged by charging unit 501 and is wound round the transfer drum 50 by winding member 502 with the leading edge of the image-transfer material held by gripper 503. Then, yellow toner images formed on the photoreceptor belt 17 are transferred onto the image-transfer material by transfer unit 504 in a rotating transfer portion. The transfer drum 50 from which the first transfer has been finished continues rotating to be cleaned by cleaner 507 for transferring the following toner images. Namely, the second rotation of the transfer drum 50 is for transferring magenta toner images, the third rotation is for cyan toner images, and the fourth rotation is for black toner images all of which are superposed in succession. After completion of transferring toner images of four colors, the image-transfer material is neutralized by separation neutralizing electrode 505, the leading edge of the image-transfer material is released by separation claw 506 from being held, and is separated and transported to fixing roller 30.

In an image forming apparatus of the present example, transfer drum 50 is on the apparatus main frame 10 and is not included in movable process cartridge 15. Therefore, the process cartridge 15 is moved in the same manner as in the aforesaid example.

As stated in detail above, in the present example, the invention provides an image forming apparatus wherein when an operator opens an upper cover, a process cartridge retreats automatically from the position where an image can be formed, and a cassette retreats from the sheet-feedable position, and for insertion thereof, on the other hand, both the process cartridge and the cassette can be set at their optimum positions.

In the image forming apparatus of the invention, therefore, an operator can clear jamming easily without hesitation and without using force because a process cartridge and a cassette move automatically when an upper cover is opened. Further, when clearing jamming, the process cartridge and the cassette are caused to retreat to the second positions. Therefore, an operator can locate the jammed paper only by a glance into the inside of the apparatus main frame through the opening formed by an opened upper cover, and work efficiency for jam clearance can be improved remarkably because big work space is secured. Further, when taking out jammed papers, there is no risk of damaging an image carrier and no risk for an operator to touch directly the image carrier. Further, since the process cartridge is moved mechanically, no unnecessary vibration is given to the process cartridge and thereby the process cartridge can be replaced or jamming can be cleared with scattering of developers that hardly takes place, resulting in easy maintenance.

Incidentally, even when the present image forming apparatus is a color printer, all of taking in and out of a process cartridge, loading and unloading of a cassette, jam clearance and toner replenishment can be conducted through the front side of the main frame. Therefore, easy operation and maintenance which are equal to those in one-direction-operation of a monochromatic printer have been achieved.

FIGS. 14–17 show another example of a color image forming apparatus of the invention.

Figure 14:
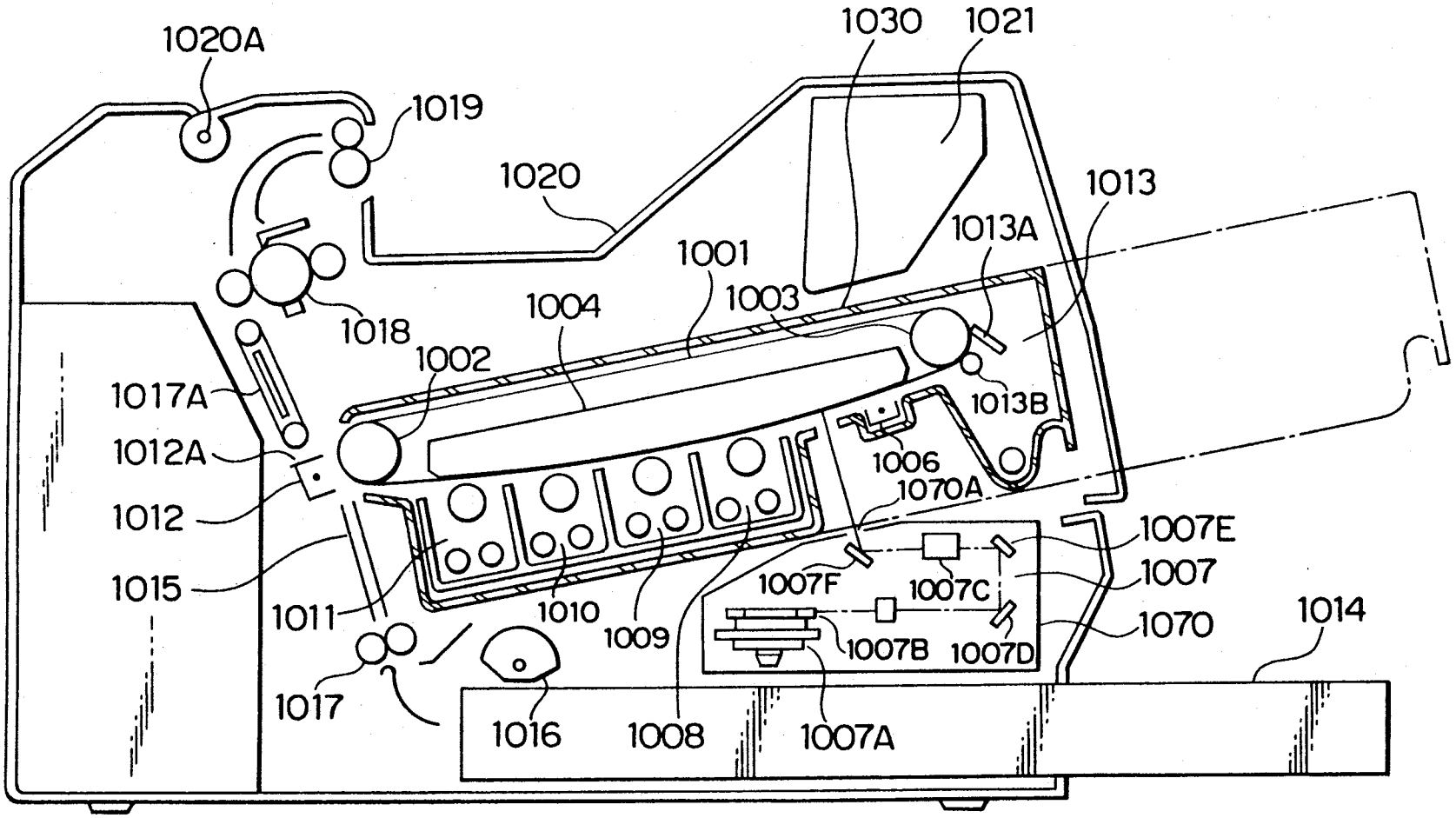
FIGS. 14, 16 and 17 represent sectional structural views of image forming apparatuses to which other examples of the invention are applied.

In FIG. 14, the numeral 1001 represents a flexible photoreceptor belt that is a belt-like image carrier and one photoreceptor belt 1001 is spread between rotating rollers 1002 and 1003 and is driven clockwise by the rotating roller 1002.

The numeral 1004 is a supporting member, namely a guide member fixed on the apparatus main frame so that it may touch the aforementioned photoreceptor belt 1001 internally. The photoreceptor belt 1001 is urged externally by the rotating roller 1003 to be tightly spread and thereby its internal surface is rubbed slidingly by the aforementioned guide member 1004.

Therefore, a photoreceptor on the external surface of the aforementioned photoreceptor belt 1001 is always kept away constant from the surface of the aforementioned guide member 1004 even when the photoreceptor is being transported, resulting in stable formation of an image forming surface.

The numeral 1006 is a scorotron charging unit which is a charging means, 1007 is a laser writing unit which is an imagewise exposure means, 1008–1011 represent developing units, namely, a plurality of developing means each containing developer of its own own color, and these developing means are arranged so that they face the external surface of the aforementioned photoreceptor belt 1001 having on its back the guide member 1004.

The aforementioned laser writing unit 1007 is contained in holding chamber 1070 having on its top surface slit like opening for exposure 1070A and is incorporated in the apparatus main frame.

For the aforementioned laser writing unit, an optical system wherein a light-emitting portion and a converging light-transmitter are united may also be used in addition to the one of an optical system type shown in the figure.

Aforementioned developing units 1008, 1009, 1010 and 1011 each containing, for example, yellow, magenta, cyan and black developers and being equipped with each developing sleeve that is kept away from the aforementioned photoreceptor belt 1001 with a predetermined clearance, have functions for visualizing a latent image on the photoreceptor belt 1001 through a non-contact developing method. The non-contact developing method has an advantage not to interrupt the movement of the photoreceptor belt, which is different from a contact type developing method.

The numeral 1012 is a transfer unit, 1012A is a neutralizing bar, and 1013 is a cleaning unit, and blade 1013A of the cleaning unit 1013 and toner transport roller 1013B are kept away from the surface of the photoreceptor belt 1001 during image formation and they are caused to be in pressure-contact with the surface of the photoreceptor belt 1001 as illustrated only in the course of cleaning after image-transfer.

A process of color image forming in the present color image forming apparatus is identical to that in the preceding example, and accordingly explanation thereof will be omitted.

Photoreceptor belt 1001, charging unit 1006, each developing unit and cleaning unit 1013 are incorporated to be united in independent process cartridge 1030 which is inserted into the apparatus in the direction shown with a dashed line.

Figure 15:
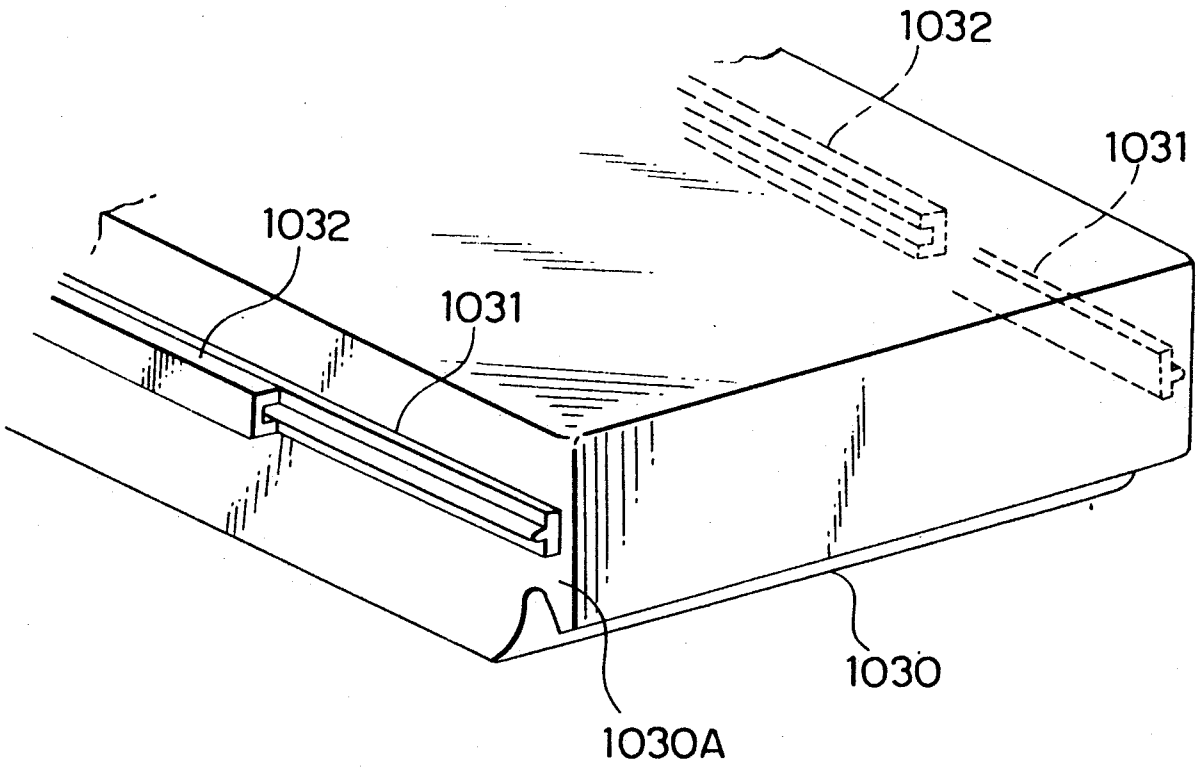
FIG. 15 is a perspective view of the primary portion of them.

Namely, the process cartridge 1030 has on its both sides rail members 1031 each having a sectional view of a protruded shape as shown in FIG. 15, and these members engage with guide members 1032 which are provided in the apparatus and have respectively a sectional view of a recessed shape, when the process cartridge is inserted.

Upper lid 1020 is provided as a cover member at an inlet on the apparatus main frame through which the aforementioned process cartridge 1030 is inserted in or drawn out, and after insertion of the process cartridge 1030, the aforementioned upper lid 1020 rotates clockwise around shaft 1020A to be closed and is held at the position where the inlet is closed.

The aforementioned upper lid 1020 is further linked with a fixing means that positions the process cartridge 1030 to the predetermined location in the apparatus, and it fixes the process cartridge 1030 to its attached position when the upper lid 1020 is closed, while when the upper lid 1020 is opened, its fixing is automatically released so that the process cartridge 1030 may be taken out.

Figure 16:
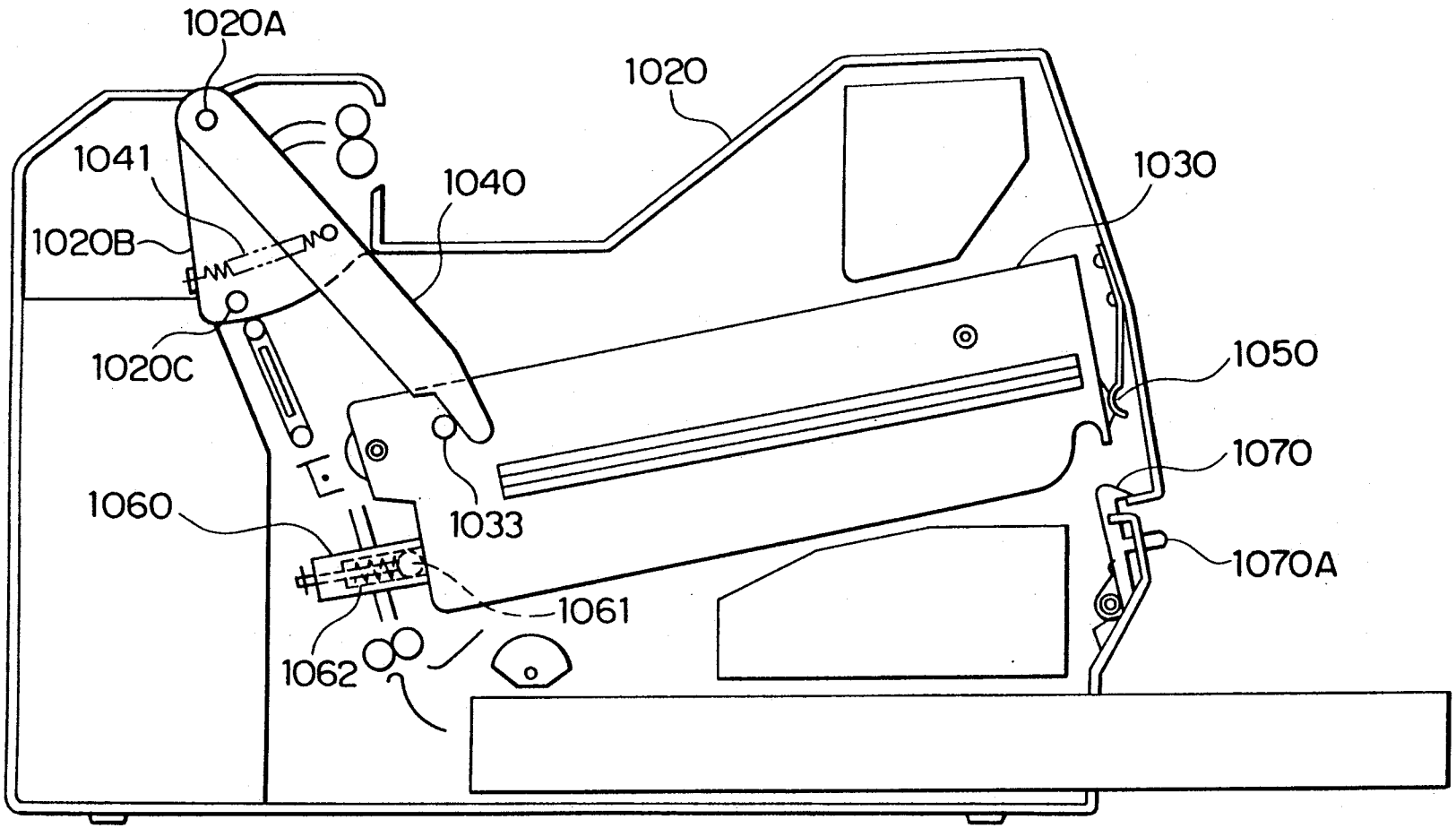

Namely, the aforementioned upper lid 1020 is equipped, as a fixing member for the aforementioned process cartridge 1030, with pressure lever 1040 and pressure spring 1050 shown in FIG. 16, and when the upper lid is closed, it causes the process cartridge 1030 to be in pressure-contact with stopper member 1060 in the apparatus main frame and urges the aforementioned photoreceptor belt 1001 and other processing items to be in positions capable of forming images, and holds them.

The aforesaid pressure lever 1040 is supported rotatably around shaft 1020A, similarly to the upper lid 1020, and it is constantly urged against the upper lid 1020 counterclockwise due to tension spring 1041 stretched between side plate 1020B of the upper lid 1020 and the pressure lever 1040. As a result, when the upper lid 1020 closes, it presses pressure pin 1033 on the side of the process cartridge 1030, thus causing the front side of the process cartridge 1030 to contact the stopper member 1060 provided on the apparatus main frame.

The aforementioned pressure spring 1050, on the other hand, presses the rear end of the process cartridge 1030 in the closed position of the upper lid 1020 and thereby further urges the process cartridge against the aforesaid stopper member 1060.

As a result, push-out pin 1061 that is built in the aforesaid stopper member 1060 holds firmly the process cartridge 1030 that is sunk in the stopper surface at the predetermined set position against compression spring 1062.

Incidentally, with regard to the aforementioned pressure lever 1040, pressure spring 1050 and stopper member 1060, each of them represents a pair provided on both sides of the process cartridge 1030 to be symmetrical each other, and thereby the process cartridge 1030 is urged against the set position in a smooth and well-balanced way.

The aforementioned upper lid 1020 is released, when protrusion 1070A of holding lever 1070 protruded outside of the apparatus is pressed, from its locked position and can be opened easily.

The upper lid 1020 released from its locked position by the aforesaid holding lever 1070 automatically rotates slightly counterclockwise due to tension spring 1041 and then stops at the position where stopper 1020C on side plate 1020B contacts the aforementioned pressure lever 1040. Under such condition, urging for the process cartridge 1030 by means of pressure lever 1040 and pressure spring 1050 is released and thereby the process cartridge is freed.

Figure 17:
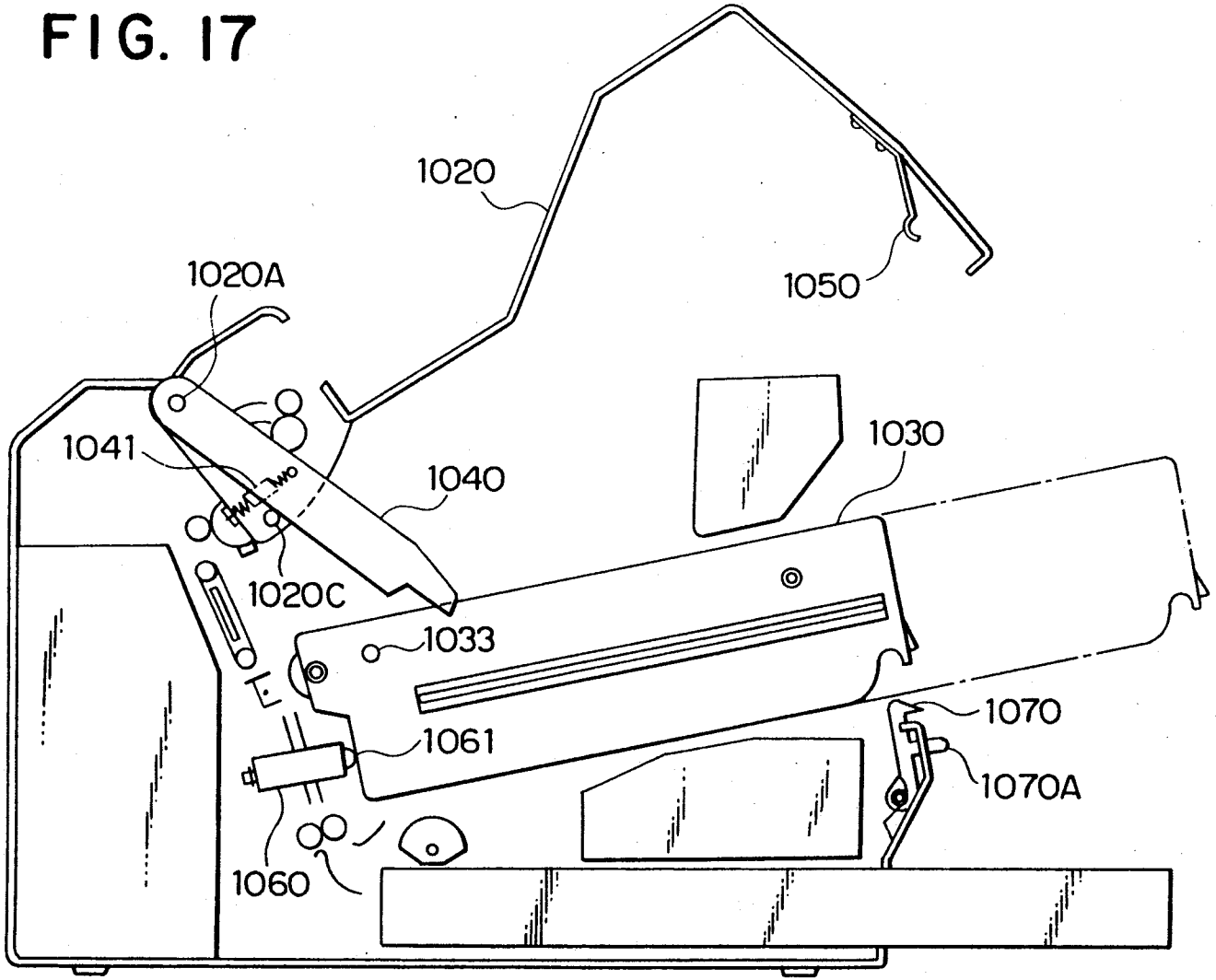

As a result, when the upper lid 20 is rotated manually counterclockwise to its stop position as shown in FIG. 17, the pressure lever 1040 retreats outside of the movement range of pressure pin 1033 of the process cartridge 1030 and push-out pin 1061 built in the aforementioned stopper member 1060 presses the process cartridge 1030, thus, it moves slightly to the right to be in a position where it can be pulled out easily.

When the process cartridge is inserted again, if the upper lid 1020 is closed and is locked by holding lever 1070 after the process cartridge 1030 is inserted to the position shown in FIG. 17, pressure lever 1040 and pressure spring 1050 generate the status shown in FIG. 16 again, thus, the process cartridge 1030 can be fixed at the predetermined setting position.

In the present example, a process cartridge can be inserted or taken out easily in an apparatus whose structure is extremely simple. As a result, maintenance work for process supplies and jam clearance for image-transfer materials can be done simply and quickly, thus, it has become possible to provide a color image forming apparatus that is excellent in terms of easy handling and production of images of a high quality.

Next example will be explained as follows.

Figure 18:
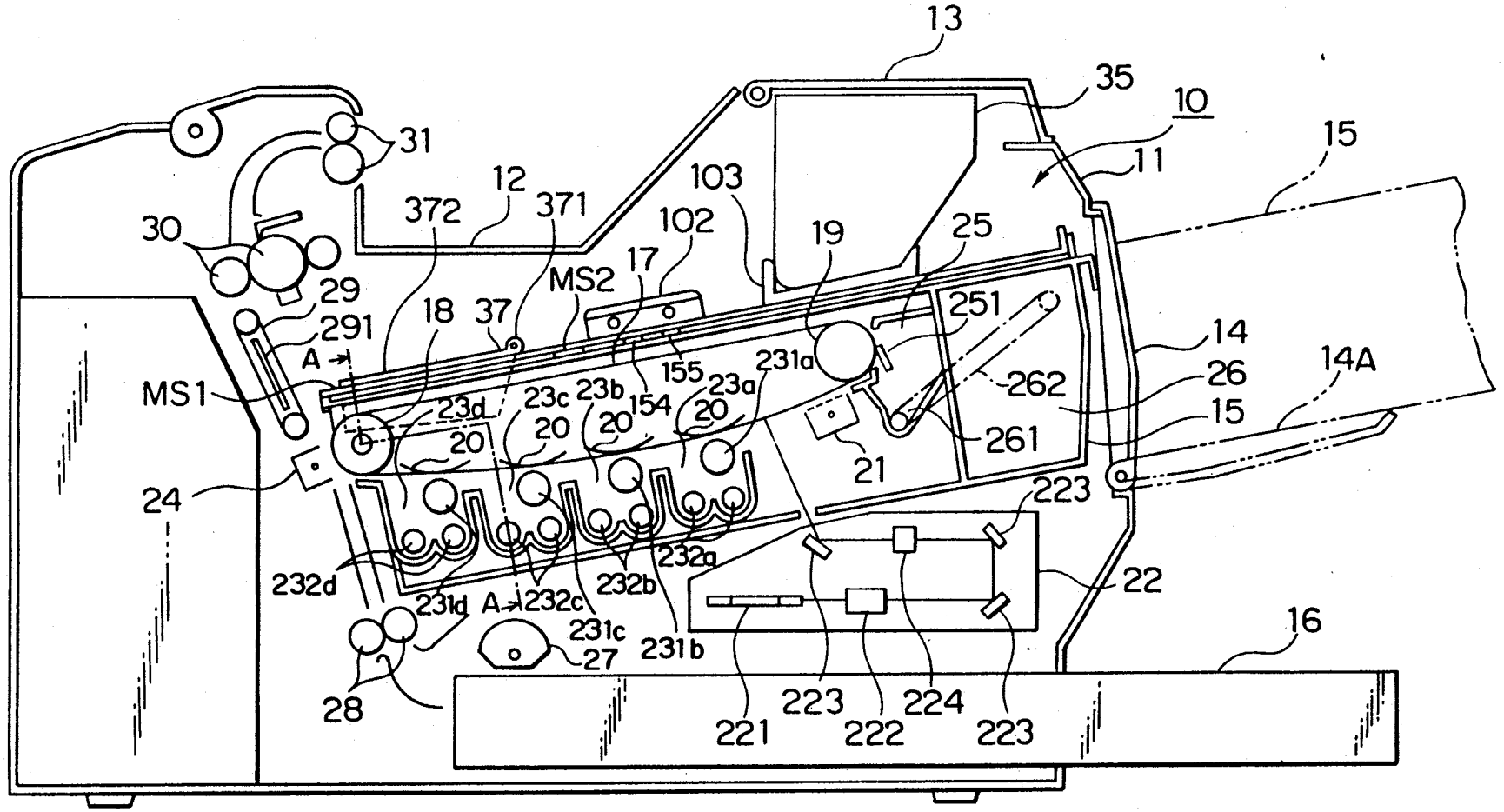
FIG. 18 is a diagram showing from the left side a primary section of a color printer to which other example of the invention is applied.

FIG. 18 shows primary sections viewed from the left side in a color printer to which the invention is applied. The front side of the apparatus main frame 10 is surrounded by operation panel 11, upper cover 12 capable of opening and closing, toner supplying cover 13 and front cover, and process Cartridge 15 capable of being inserted or pulled out and sheet feeding cassette 16 are loaded inside of the apparatus main frame.

In FIG. 18, main parts or items identical to those in FIG. 1 are given the same numbers or symbols and explanations for overlapping parts or items will be omitted.

In the present example, processing units such as photoreceptor belt 17, charging unit 21, developing units **23*a*–23*d* containing different color toners respectively, cleaning means 25 and toner collection box 26 all constituting an image forming portion of the printer mentioned above are contained solidly in process cartridge 15 to be a unit which can be inserted in or pulled out of the apparatus main frame 10 together. However, processing units contained in the process cartridge 15 to be a unit are not limited to those, and at least photoreceptor belt 17 and developing units 23*a*–23*d*, or photoreceptor belt 17 and cleaning means 25** need to be contained to be a unit, and other processing units may be combined together to be a unit.

Figure 19:
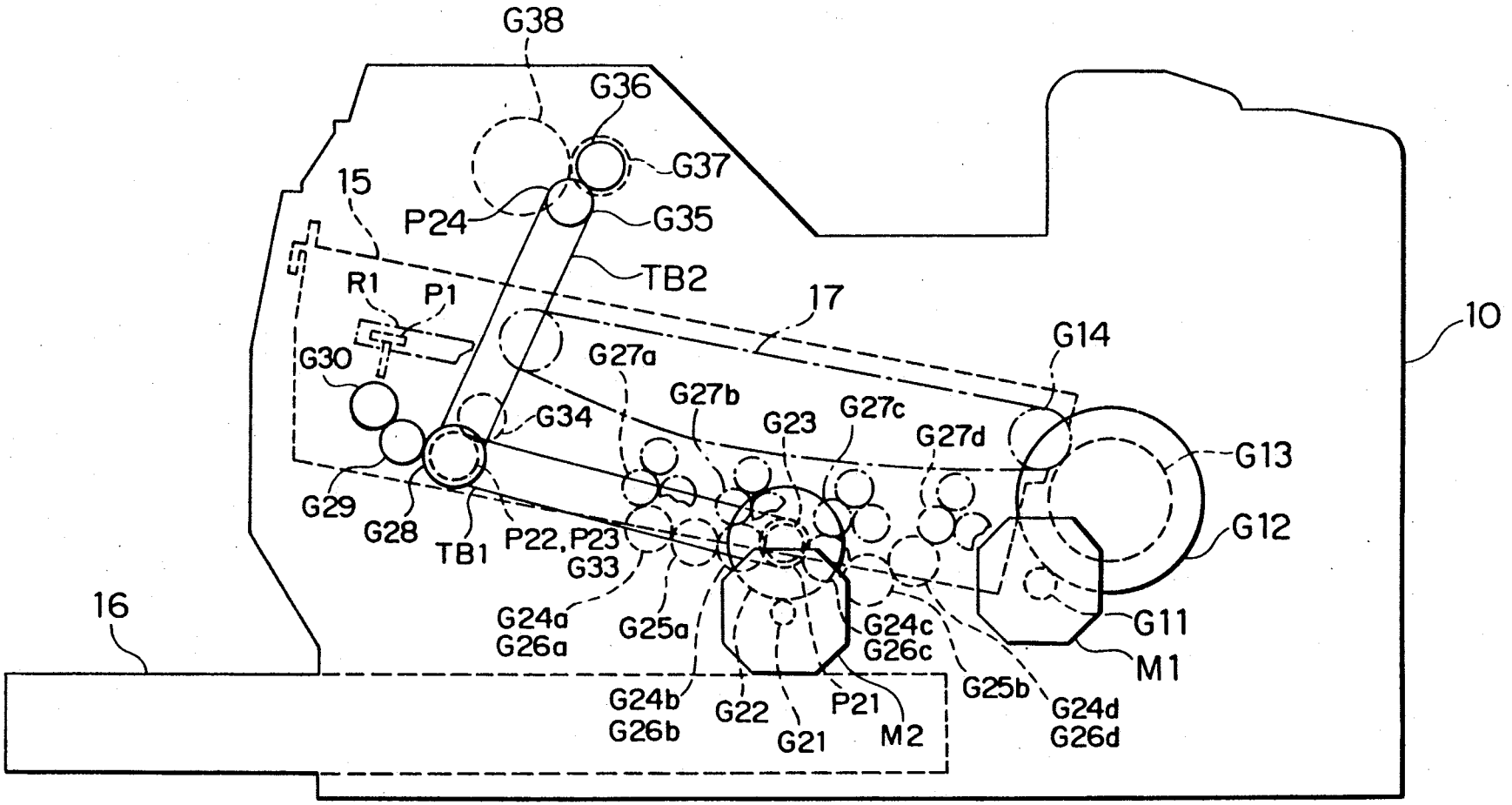
FIG. 19 is a diagram showing from the right side a driving system related to the invention.
Figure 20:
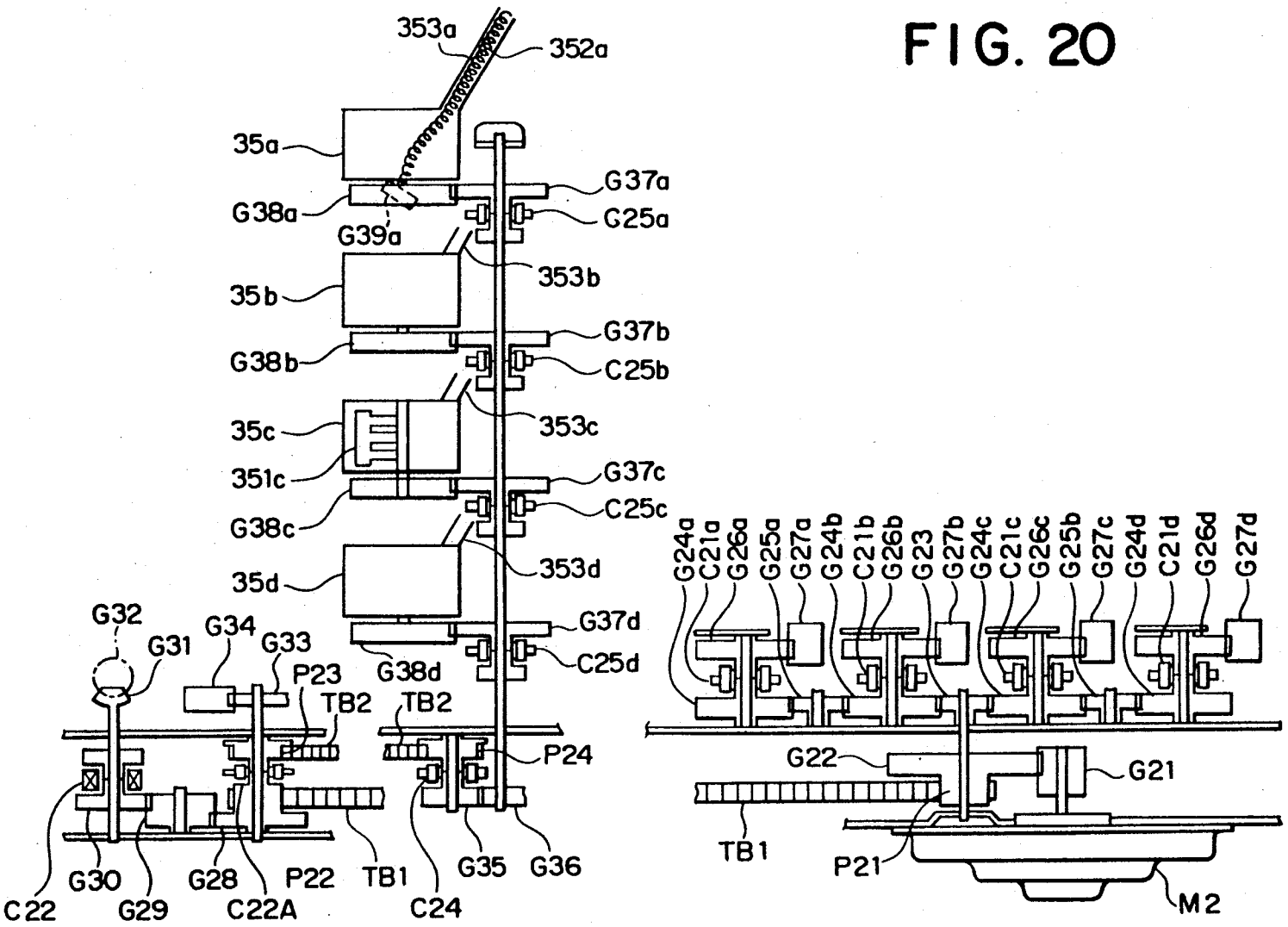
FIG. 20 is a diagram showing from the top a driving system for the movement of a process cartridge.
Figure 21:
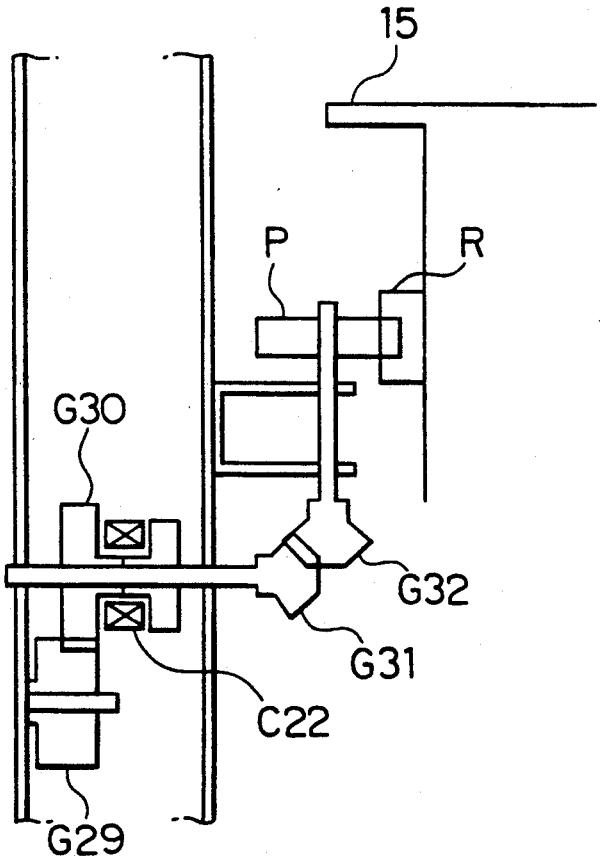
FIG. 21 is a diagram showing the primary portions of a driving system for the movement of a process cartridge.
Figure 22:
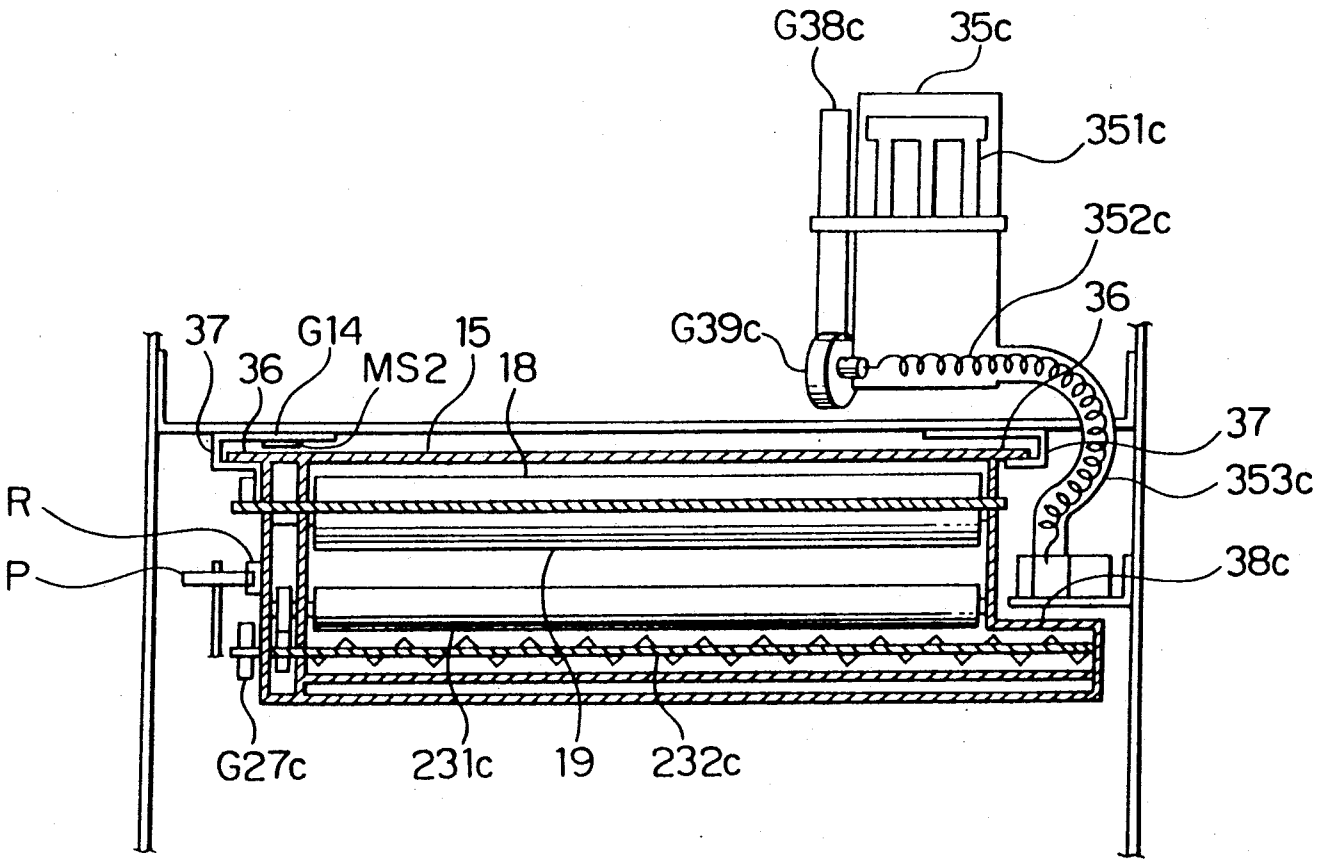
FIG. 22 is a sectional view taken on line A—A in FIG. 18.

FIG. 19 is a diagram showing a driving system for process cartridge 15 and a driving system for moving the process cartridge 15, from the right side. Incidentally, both the driving system for process cartridge 15 and the driving system for moving the process cartridge 15 shown in the present example employ two motors Ml and M2.

First, for the driving system of photoreceptor belt 17, driving power coming from motor Ml is used. Gear G12 is arranged so that it may engage with gear G11 provided on a shaft of motor M1. When the process cartridge 15 is in a position capable of forming an image, driving gear G 14 provided to be coaxial with driving roller 18 which transports the photoreceptor belt 17 engages with gear G13 that rotates together with gear G12. Namely, the rotation of motor Ml is transmitted to driving gear G14 through gear G11, gear G12 and gear G13 to be adjusted to optimum speed of revolution, and rotates further driving roller 18 counterclockwise in the figure together with driving gear G14, thus, the photoreceptor belt 17 is transported.

Next, a means for moving process cartridge 15 will be explained, referring FIGS. 18–23.

Rotating force of motor M2 transmitted to gear G22 is transmitted to pulley P22 through pulley P21 that rotates together with the gear G22 and timing belt TB1, and drives a driving system for a driving means for the process cartridge.

With regard to the driving system for the driving means for the process cartridge, rotating force transmitted to pulley P22 is transmitted to gear G29 engaging with gear G28 that rotates together with the pulley P22, and is further transmitted to gear G30 engaging with the gear G29. The aforementioned rotating force is transmitted to gear G31 through electromagnetic clutch C22 which operates based on signals obtained through detection when front cover 14 is opened by an operator in case of need such as an occasion of occurrence of transport trouble for image-transfer materials or periodical inspection for maintenance. Gear G31 and gear G32 form a gear pair with intersecting axes, and rotating force transmitted to the gear G31 is transmitted to pinion P by the gears G31 and G32.(See FIG. 22.) Incidentally, the front cover 14 may either be opened directly by an operator, or be opened automatically by a button for opening pressed. The pinion P can engage with rack R provided on the side of process cartridge 15, and rotation of the pinion P and slide of the rack R move the process cartridge 15 from side to side. With regard to the movement of the process cartridge 15 an explanation will be given as follows, referring to FIG. 22 that is a sectional view taken on line A—A in FIG. 18 and FIGS. **23-*a*–23-*c* which show explanatorily the movement of the process cartridge 15**.

First, when pulling out process cartridge 15, the process cartridge 15 is in the first position as shown in FIG. **23-*a*, driving roller 18 is away from transfer electrode 24 with a desirable distance (desirable pressure when a transfer member is a transfer drum), and driving gear G14 provided on process cartridge 15**, developing unit driving gears G27*a*–G27*d*, and waste toner screw driving gear G34 are engaging respectively with gear G13, gears G26*a*–G26*d*, and gear G33 all provided on apparatus main frame 10, which represents an optimum condition for image forming. Further, rack R and pinion P are engaging each other.

When front cover 14 is opened manually by an operator or it is opened by pressing a pull-out button on operation panel 11 provided on the front side of the apparatus main frame 10, the pull-out signals are inputted in a control unit. In this case, when print signals from a print button on operation panel 11 and image forming process signals such as photoreceptor belt driving signals, fixing unit driving signals, sheet ejection driving signals and sheet feeding driving signals all representing respectively that a photoreceptor belt driving unit, a fixing unit, a sheet ejecting unit and a sheet feeding unit are in operation, are not generated, the control unit sends signals to motor M2 and electromagnetic clutch C22 which form a driving section of a moving means for a process cartridge and thereby rotates pinion P for the purpose of moving the process cartridge 15 from the first position to the second position, thus the process cartridge 15 is moved toward the second position along guide member 37. (See FIG. **23-*b*.) In this case, the process cartridge 15** moves without damaging the surrounding items because it moves being guided by a precise path as stated above.

When the process cartridge 15 moves as shown in FIG. **23*c*, the second microswitch MS2 is turned off, which detects that the process cartridge 15** has moved to the second position, and signals from that detection are sent to the control unit. Upon receiving the signals, the control unit releases the electromagnetic clutch C22 and causes the motor M2 to stop running.

Namely, the process cartridge 15 stops at the second position under the state that rack R and pinion P are engaging each other, and retreats from the first position to the second position. Under such state, therefore, a large work space for jam clearance can be secured. Further, since each item is away from other items with enough distance under the aforesaid state, the process cartridge 15 can be pulled out slightly from the second position without requiring any skill and tension, and thereby can be pulled out of the apparatus main frame 10 easily.

On the contrary, when the process cartridge 15 is inserted in the apparatus main frame 10, it can be conducted simply, safely, firmly and quickly that the process cartridge 15 is inserted and located with its protrusion 36 being guided by guide member 37 provided in the process cartridge containing chamber, rack R and pinion P are caused to engage each other, then the process cartridge 15 arrives at the second position shown in FIG. **23-*c***, and passes through that point slightly to arrive at the position where the aforesaid second microswitch MS2 is turned on.

In order to move the process cartridge 15 from the aforesaid state to the first position where an image can be formed, setting signals are inputted the control unit by inserting further the process cartridge 15 positioned at the second position, or by pressing a set button located on operation panel 11. After these setting signals are inputted, the control unit sends signals to motor M2 and to electromagnetic clutch C22, and rotates (in direction opposite to that for pulling out) pinion P for moving the process cartridge 15 from the second position to the first position, thus, the process cartridge 15 can be moved automatically in an extremely precise and safe way (FIG. **23-*c***).

Further, when the process cartridge 15 moves, the first microswitch MS1 detects that the process cartridge 15 has moved to the first position as shown in FIG. **23-*a* and sends that information to the control unit. The control unit, upon receiving that information, releases electromagnetic clutch C22 and causes the motor M2 to stop running. To be concrete, the process cartridge 15 stops at the first position, driving gear G14 provided on the process cartridge 15**, developing unit driving gears G27*a*–G27*d* and waste toner screw driving gear G34 engage respectively with gear G13, gears G26*a*–26*d* and gear G33, and further, front cover 14 closes to create the state capable of forming an image. Under such state, toner inlets 38a–38d of developing units 23a–23d in the process cartridge 15 are connected automatically to respective tip joint portions of toner transport tubes 353a–353d of corresponding toner hoppers 35a–35d, to create the state of toner replenishment. Incidentally, while the process cartridge 15 is moving, each joint portion is automatically disengaged and a shutter is closed, which is not illustrated. However, the inlet of each developing unit remains opened facing upward, but no toners drop because the process cartridge is kept horizontally or almost horizontally, which is an advantageous point. After replacement of process cartridge 15 or jam clearance, therefore, the process cartridge 15 can be inserted automatically with a simple operation, which reduces troublesomeness of an operator sharply and causes the process cartridge 15 to be set at the position where an image can surely be formed.

On the other hand, an upper cover opening means will be explained below referring to FIGS. 24-*a* and 24-*b* as an example of an opening means for a cover such as an upper cover or a front cover. Upper cover 12 is supported rotatably by upper cover shaft 39. Owing to coil spring 40 wound round the upper cover shaft 39 and to pin 41 whose one end is attached on the apparatus main frame 10 and the other end is attached on the upper cover, the upper cover 12 is urged to open, namely, spring-urged to rotate counterclockwise in the figure. Solenoid 42, on the other hand, is positioned so that it can hold the upper cover 12 when the upper cover 12 is closed.

Figure 24A:
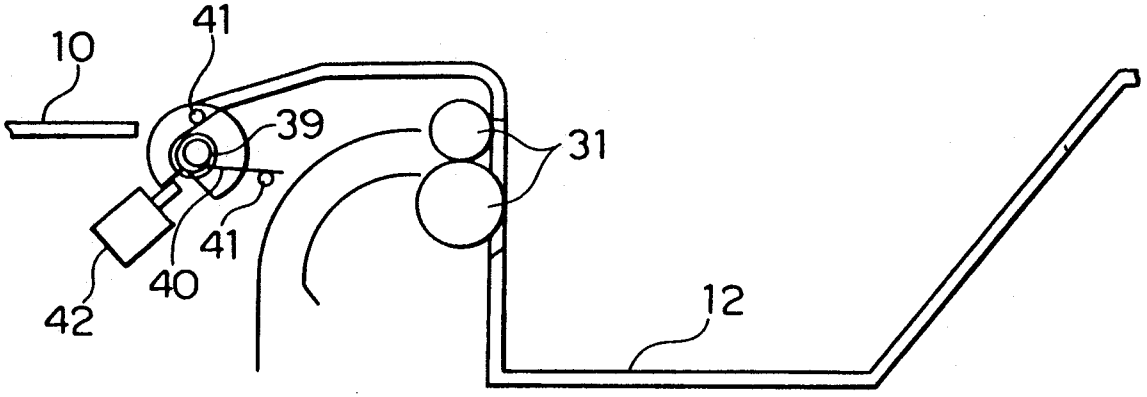
FIGS. 24-*a* and 24-*b* represent diagrams showing a opening mechanism for an upper cover.
Figure 24B:
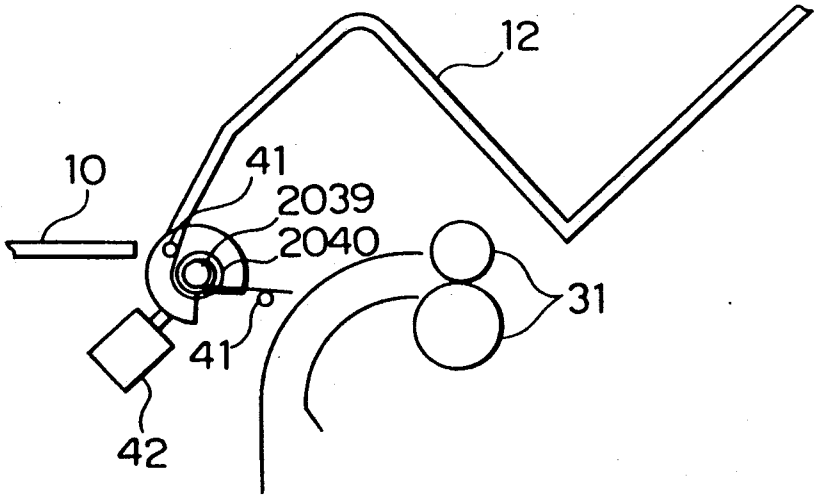

Due to the upper cover opening means having the constitution mentioned above, the upper cover 12 in the image forming process is in its closed state and it serves also as a delivery tray for the image-transfer material after transferring to be ejected by delivery roller 31 (FIG. 24-*a*). In the case of jam clearance or the like, when a pull-out button on operation panel 11 provided on the front side of the apparatus main frame 10 is pressed and image forming process signals are not generated, the control unit sends movement signals for moving the process cartridge 15 to the process cartridge moving means as stated above, and simultaneously sends signals for opening to solenoid 42 that is an upper cover opening means. The solenoid 42, after receiving the signals for opening, retreats its shaft, namely discontinues holding the upper cover 12. Then, spring-urged upper cover 12 is opened by the urging force of the spring (FIG. 24-*b*). Through the opening formed by the upper cover 12 thus opened, it is possible to locate, in a simple way, the image-transfer material causing jamming and remove it easily. Incidentally, an upper cover opening means is not limited only to that in the present example, but it may be the one capable of holding the position opposite to the upper cover shaft 39. Further, it is possible to employ another upper cover opening means wherein the upper cover shaft 39 is provided with a gear and a motor that engages with the gear, and when signals for opening are generated from the control unit, the motor rotates to open the upper cover 12. In this case, it is also possible to arrange so that the motor rotates reversely and closes the upper cover 12 when set signals are inputted in the control unit.

The foregoing is explanation of the opening and closing mechanism for upper cover 12, but the opening and closing mechanism for the front cover 14 can be exactly the same as that for the upper cover 12.

Namely, when releasing the process cartridge 15, an unillustrated button on operation panel 11 for opening front cover is pressed, and then the front cover 14 is released from holding and thereby opens, and its opening is detected and its detection signals further advances the releasing steps for the process cartridge. Front cover 14 can naturally be opened manually. The point is that the detection signals of opening can be obtained, and such detection can easily be obtained.

Figure 25:
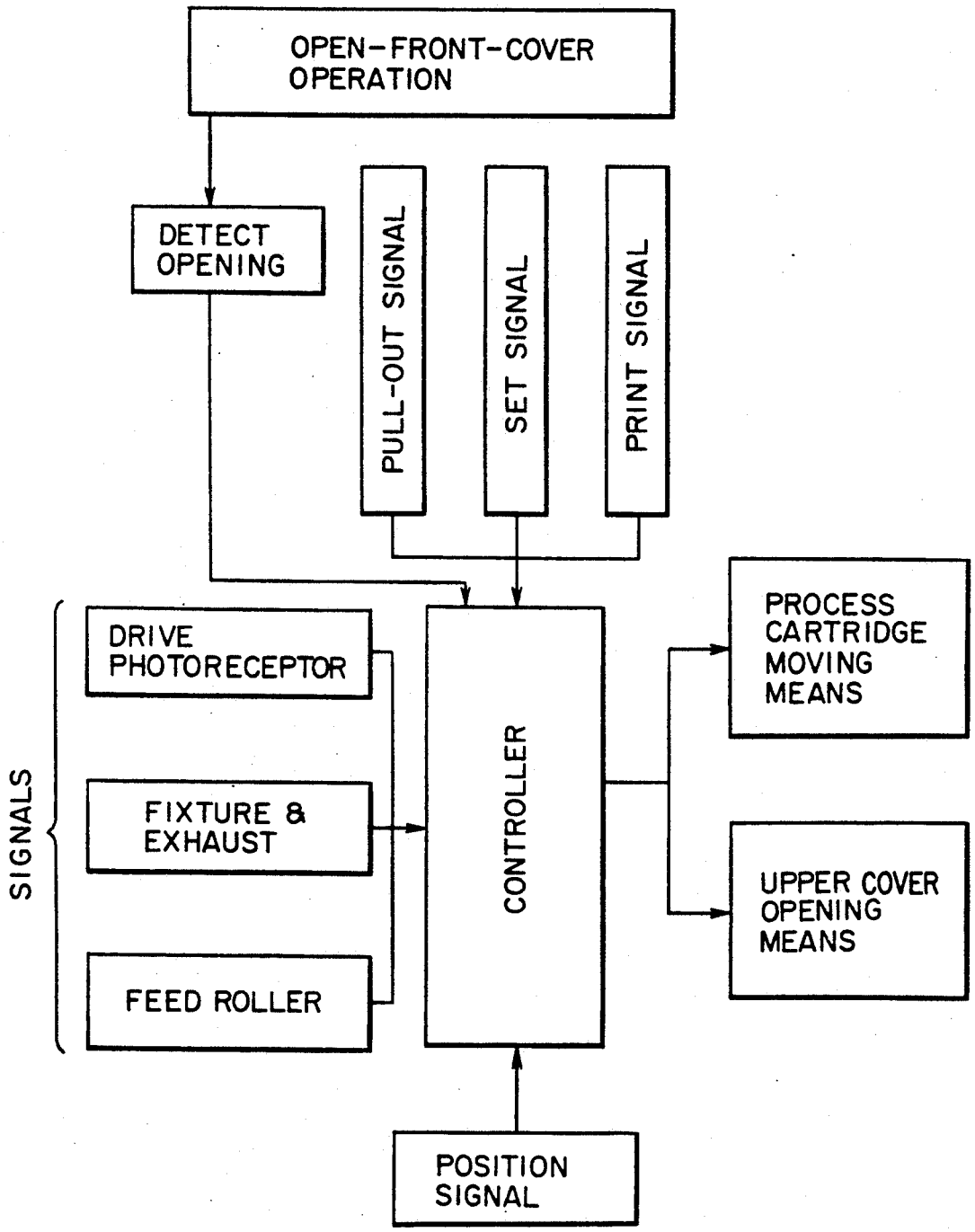
FIG. 25 is a diagram showing a control system.
Figure 26:
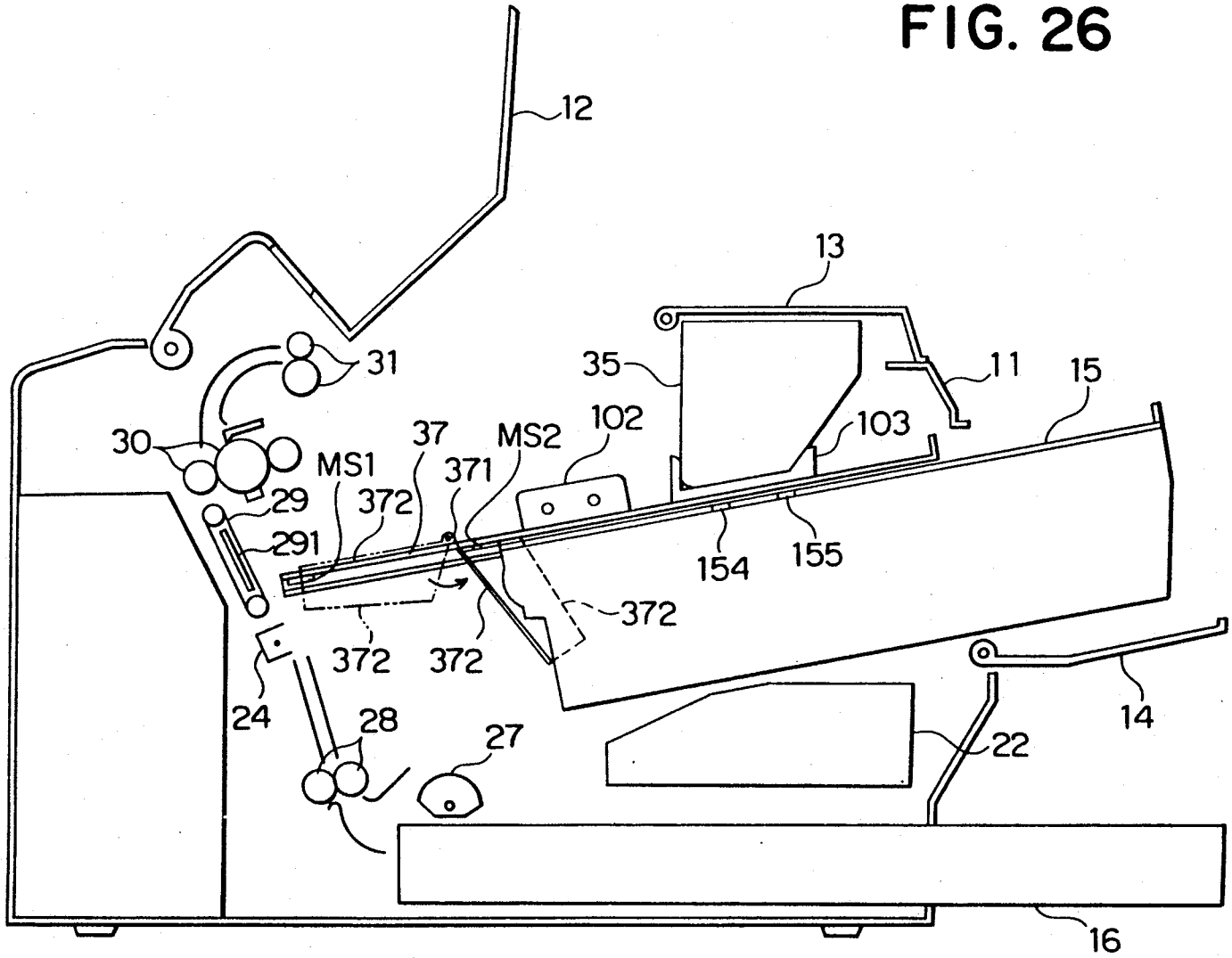
FIG. 26 is a diagram showing from the left side a color printer wherein a process cartridge is in its second position.

The control of the movement of the process cartridge 15 and the control for opening the upper cover 12 both made by opening of the front cover 14 explained above are shown in FIG. 25. Namely, pull-out signals are inputted in the control unit and are indicated on operation panel 11. Based on the indication, an operator opens front cover 14. In this case, if there are not generated print signals from an operation panel, as well as photoreceptor belt driving signals, fixing-sheet ejection driving signals and sheet feeding driving signals coming respectively from a photoreceptor belt driving unit, fixing and sheet ejecting unit and sheet feeding unit and indicating respectively that they are driving, in connection with what the opening is detected, the control unit sends signals for opening to the process cartridge moving means. The process cartridge moving means portion controls a process cartridge movement driving system for moving the process cartridge 15 from the first position to the second position, and then stops the process cartridge movement driving system when position detection signals detecting that the process cartridge 15 has moved to the second position are obtained. On the other hand, the control unit sends movement signals to the process cartridge moving means and simultaneously sends signals for opening also to the upper cover opening means for opening the upper cover 12. In other words, when jamming takes place or process cartridge 15 is replaced, the trouble is first detected and then image forming procedures are stopped. Then, the contents of the trouble are indicated as a flashing message on operation panel 11, and interlocking with that, the process cartridge 15 retreats to the second position and the upper cover 12 opens automatically as shown in FIG. 26, thereby it is possible to locate the jammed image-transfer material and take it out easily. Further, when a photoreceptor belt reaches its life in terms of the number of used cycles, its message appears on the operation panel 11. Therefore, the process cartridge 15 located in the second position can be pulled out slightly, and then taken out while it is guided slidingly by guide surface 14A on the reverse side of the front cover 14, which means easy replacement of process cartridge 15.

In addition to the above, toner replenishment sign, waste toner full sign, and no paper in cassette sign are indicated on the operation panel 11 for an operator to operate easily. In this case, waste toner collection box 26 located in the rear of process cartridge 15 is out of the apparatus main frame 10 when the process cartridge is retreated to the second position. Therefore, it is possible to remove easily the waste toners collected in a bag in the waste toner collection box 26 together with the bag.

In the present example, an image forming method wherein a color toner image is formed on a photoreceptor belt and then the image is transferred onto an image-transfer material at a time has been explained as an image forming process. However, the color image forming method may be one wherein toner images are transferred onto an image transfer sheet wound round a transfer drum on a repeating basis. It is also possible to apply to a conventional monochromatic printer wherein a monochromatic process is employed. Further, although a non-contact type developing method has been explained as a developing method in the present example, the invention is not limited to the non-contact developing, but can be applied also to a developing method of a contact type. Further, a driving system shown in the present example is only an example and the invention is not naturally limited only to a combination of these gears, clutches and belts.

Figure 27:
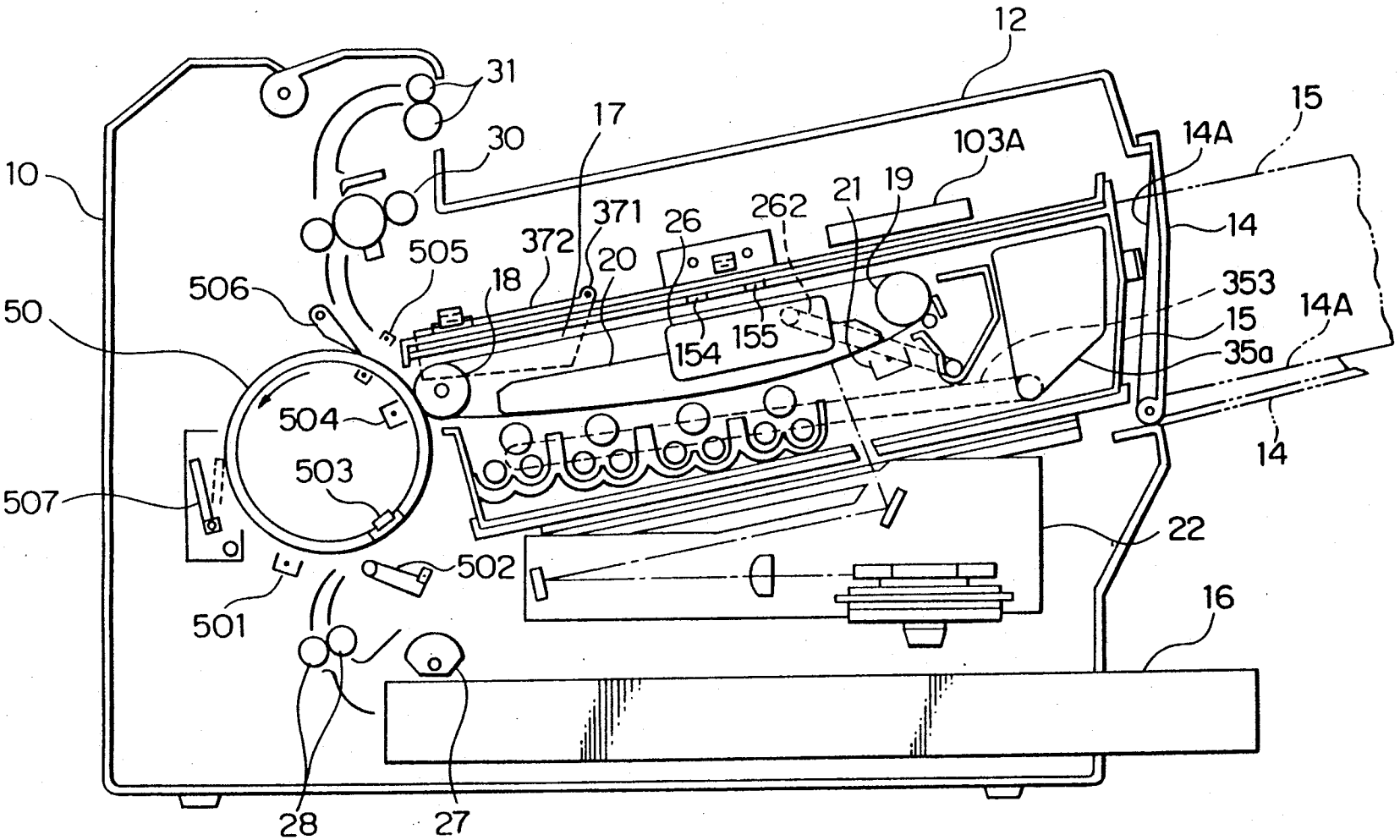
FIG. 27 represents a primary sectional view of an image forming apparatus of a transfer drum type to which the invention is applied.

FIG. 27 shows an image forming apparatus of a transfer drum type as another example to which the invention is applied. In the apparatus, toner hopper 35*a* is incorporated in process cartridge 15 to be a unit, though a portion of process cartridge 15 is mostly the same as that in the preceding example. In the image forming apparatus of a transfer drum type, transfer drum 50 is held to be in contact with a transfer portion on photoreceptor belt 17, and the transfer drum 50 rotates counterclockwise synchronizing with the photoreceptor belt 17. An image-transfer material is wound round the transfer drum 50, a toner image of each color formed on the photoreceptor belt 17 is transferred onto the wound image transfer material. After images of different colors are superposed on the image transfer material, the image-transfer material is separated from the transfer drum 50 and is delivered on the top of the apparatus main frame 10 after being fixed.

Around the transfer drum 50, there are provided charging unit 501 that is for causing the image-transfer material to be attracted electrostatically and winding member 502 that is for winding the image-transfer material mechanically around the transfer drum 50. The winding member 502 has a roller at its tip and contacts only when the image-transfer material starts winding itself round the transfer drum 50 On the peripheral surface of the transfer drum 50, there is provided gripper 503 which functions to hold the leading edge of the image-transfer material transported synchronously. Transfer unit 504 transfers electrostatically a toner image on the photoreceptor belt 17 onto an image transfer material. Separation neutralizing electrode 505 and separation claw 506 separate the image-transfer material after transferring from the transfer drum 50. Further, cleaner 507 capable of contacting with and leaving from the transfer drum removes residual toners remaining on the transfer drum 50 after separation of the image-transfer material.

An image transfer material fed from cassette 16 advances synchronously to the transfer drum 50 charged electrically by charging unit 501, and then is wound by winding member 502 and rotates, with its leading edge held by gripper 503, to the transfer portion where a yellow toner image formed on the photoreceptor belt 17 is transferred onto the image transfer material by the transfer unit 504. The transfer drum 50 after completion of the first transferring continues rotating to be leaned by cleaner 507 for transferring of the following toner image. Namely, a magenta toner image for the second cycle, a cyan toner image for the third cycle and a black toner image for the fourth cycle are transferred successively so that they are superposed. After completion of successive transferring for toner images of four colors, the image-transfer material is neutralized by separation neutralizing electrode 505, then is separated by separation claw 506 with its leading edge released from holding, and then is transported to fixing roller 30.

In the image forming apparatus of the present example, the transfer drum 50 is located on the apparatus main frame 10 and is not included in movable process cartridge 15. Therefore, the process cartridge 15 can be moved in the same way as in the previous example.

When process cartridge 15 is moved from the first loading position to the second loading position, upper cover 12 is opened and wide space is created around transfer unit 24, transport path 29 and fixing unit 30 Therefore, it is easy to take actions when trouble happens. Under such condition, however, an exposure portion on the photoreceptor belt is risked to light-fatigue. Therefore, photoreceptor cover 372 that rotates around supporting shaft 371 fixed on the main frame is provided at a tip portion of guide member 37 for the process cartridge 15 provided on the apparatus main frame 10. The photoreceptor cover is constantly urged by a torque spring to rotate counterclockwise, and when the process cartridge 15 is in the first loading position, it is lifted up at the external top surface at its tip portion and the photoreceptor belt is opened facing transfer unit 24 and transfer drum 50 as shown in FIG. 10.

However, when the process cartridge 15 retreats to the second loading position as shown in FIG. 26, the exposure portion of a photoreceptor at the tip portion of the process cartridge 15 is covered by the photoreceptor cover 372 to be light-tight.

On the other hand, for a neutralizing device composed of a neutralizing lamp or a neutralizing electrode, or for operation member block 102 wherein an exposure means is provided, openings 154 and 155 are provided at the positions corresponding to the process cartridge 15 in the case of the first loading position. The image-transfer material is arranged so that it may neutralize the photoreceptor belt 17 after transferring.

However, when process cartridge 15 retreats to the second position and upper cover 12 is opened, external light comes in through the aforementioned openings 154 and 155 to risk the photoreceptor to light-fatigue. In order to prevent it, there has been devised constitution wherein when the process cartridge 15 retreats to the second loading position, the aforementioned openings 154 and 155 hide behind the reverse side of stand 103 for hoppers 35 arranged on the main frame 10, or the reverse side of shielding plate 103A specially provided as shown in FIG. 27 to keep the light-tight condition.

As stated above in detail, according to the invention, it is possible to provide an image forming apparatus wherein a front cover is opened based on signals for trouble occurrence, expiration of life in terms of the number of usage cycles and waste toner full, and interlocking with this opening of the front cover, the process cartridge retreats from the position capable of forming an image and the upper cover opens, thus it is possible to cope with the trouble simply and certainly.

Further, in the image forming apparatus of the invention, a process cartridge can be moved automatically with a simple operation and an upper cover can be opened. Therefore, an operator can replace process cartridges easily without being puzzled and without using a big force. Further, for jam clearance, the process cartridge retreats to the second position, thus the inside of the apparatus main frame can be viewed through the opening for the upper cover, and a large work space can be secured. Therefore, efficiency of jam clearance can be improved remarkably, and when taking out jammed image-transfer materials, there is no risk that an image-carrier is damaged or it is touched directly by operator's hands. In addition to the above, process cartridges can be replaced or jamming can be cleared without giving unnecessary vibrations to the process cartridge and with little scattering of developers, because the process cartridge can be moved mechanically while keeping it horizontally or keeping it at an inclination that is almost horizontal, which results in an effect of improvement in maintainability. Incidentally, when the present image forming apparatus is a color printer, insertion and taking out of a process cartridge, loading and unloading of a cassette, jam clearance and toner replenishment can be conducted through the front side of the main frame, thus easy handling and maintainability same as those in one direction operation in a monochromatic printer have been realized.

Figure 28:
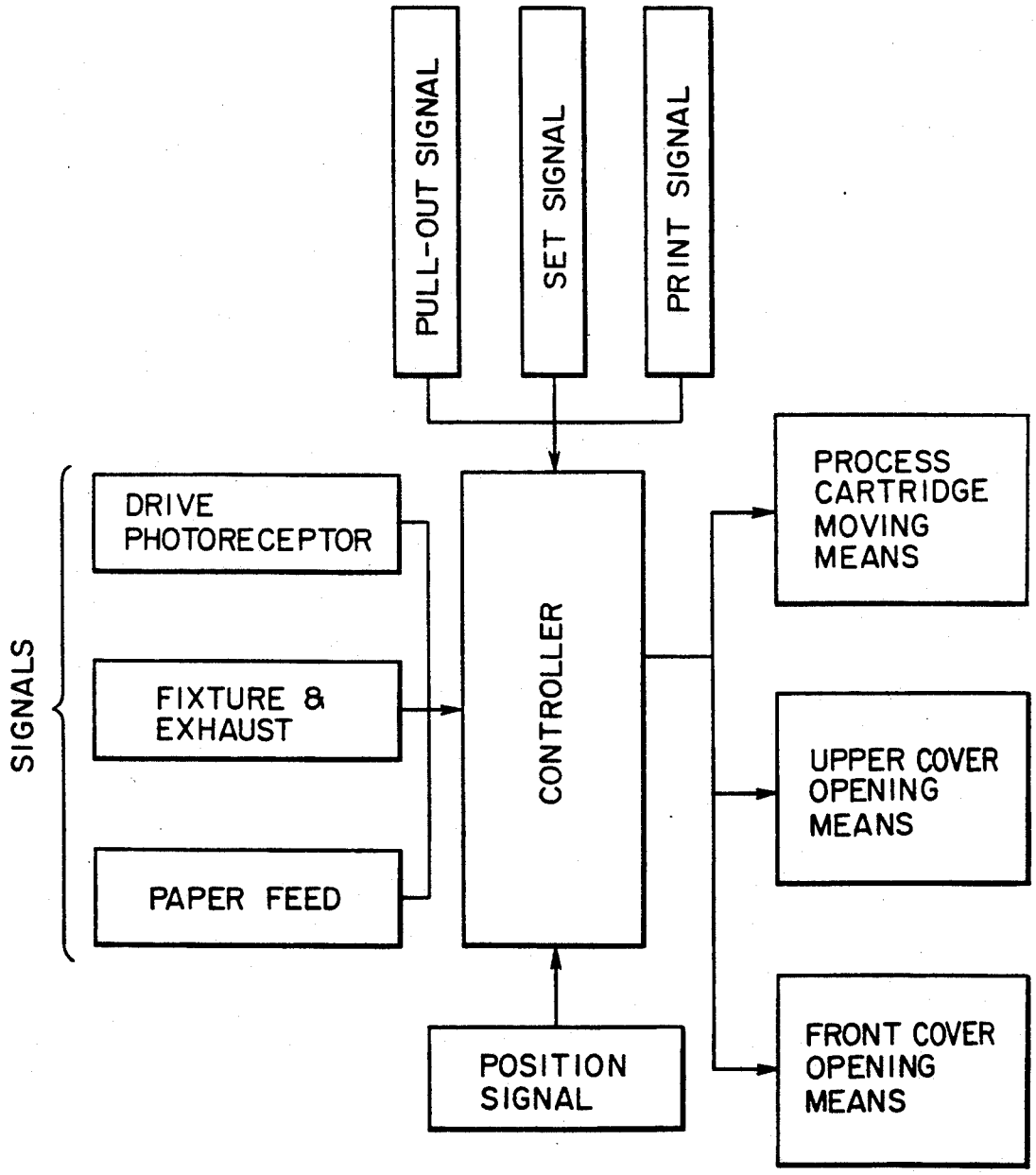
FIG. 28 shows a movement control system for a process cartridge and an opening control system for the upper and front covers.

Examples modified from the examples explained in the aforementioned FIGS. 18–27 will be explained as follows referring to FIG. 28 and other figures used previously. Explanations overlapping with those of the preceding examples will be omitted in principle.

In FIGS. 18–28, when troubles happen on a transferring body, a warning lamp flashes automatically. When an operator presses a pull-out button for a process cartridge on operation panel 11 provided on the front side of the apparatus main frame 10, responding to the warning lamp, pull-out signals are inputted in the control unit. In addition, even when pulling out the process cartridge 15 for maintenance, if the aforesaid pull out button is pressed, the same signals are inputted. In this case, when print signals from a print button on operation panel 11, and image forming process signals such as photoreceptor belt driving signals, fixing unit driving signals, sheet delivery driving signals and sheet feed driving signals representing respectively that image forming processes including photoreceptor belt driving portion, fixing portion, sheet delivery portion and sheet feeding portion are operating, are not generated, the control unit generates first the signals for opening front cover 14 to open the front cover 14, and further generates signals to motor M2 and electromagnetic clutch C22 which are the driving portion of a process cartridge moving means, and then rotates pinion P for moving the process cartridge 15 from the first position to the second position, thus the process cartridge 15 is moved toward the second position along guide member 37. (See FIG. 23-*b*.) In this case, the process cartridge 15 is moved being guided along the precise path as mentioned previously, and thereby it does not hurt the surrounding items. It is also possible to cause the front cover 14 to be opened automatically by the signals for start moving of the process cartridge 15.

Figures 23A, 23B, 23C:
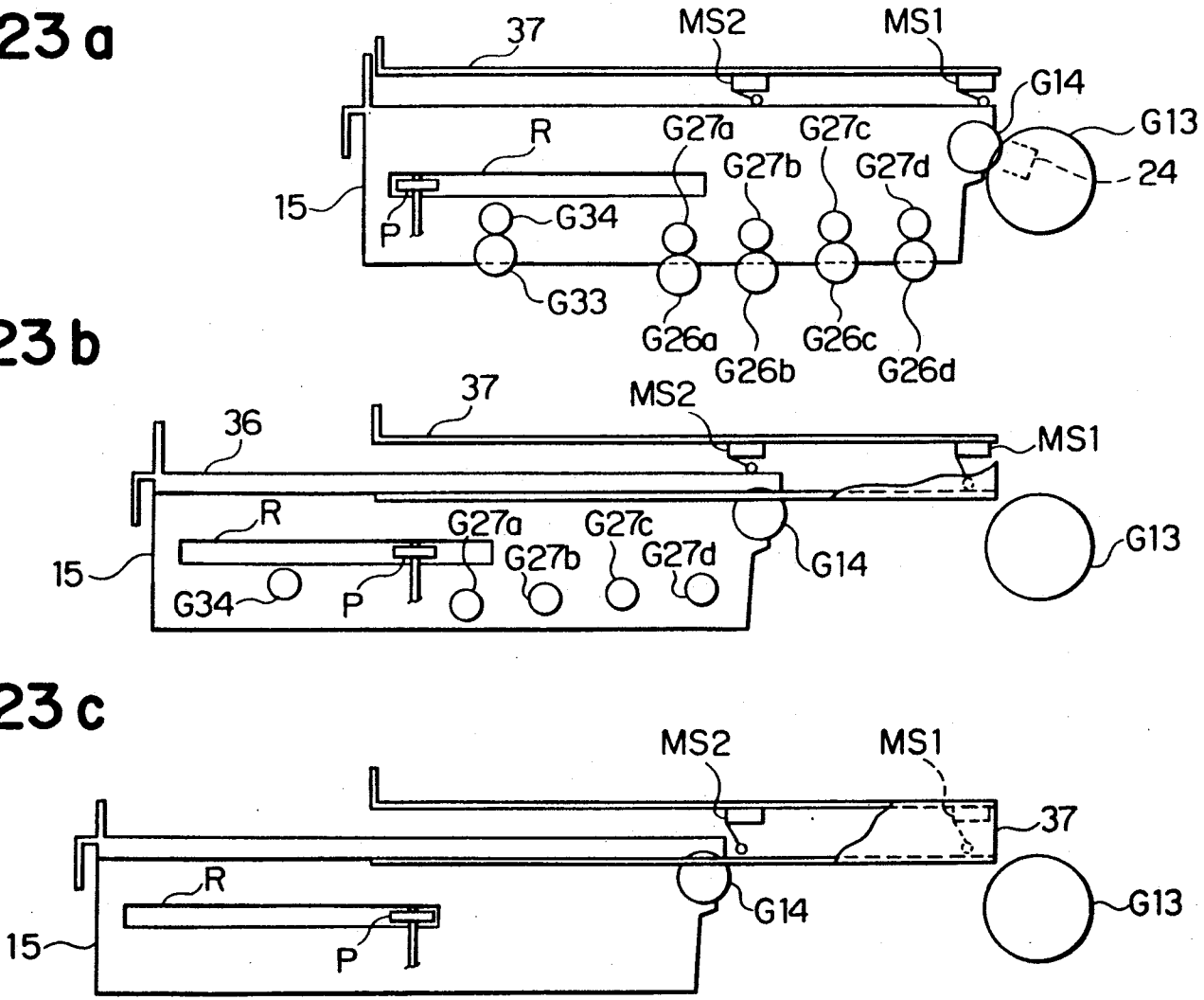
FIGS. 23-*a*-23-*c* represent illustrating diagrams showing typically the movement of a process cartridge.

As shown in FIG. 23-*c*, when process cartridge 15 moves, the second microswitch MS2 is turned off to detect that the process cartridge 15 has moved to the second position, and sends that signal to the control unit. Upon receiving that signal, the control unit releases the electromagnetic clutch C22 and stops the rotation of motor M2.

Namely, the process cartridge 15 stops at the second position under the state where rack R and pinion P are engaging each other, and retreats from the first position to the second position. In this position, therefore, a large work space for jam clearance can be secured. Further, under this state, relevant members can be sufficiently away from each other, and opened front cover 14 forms a guide for pulling out manually from the second position, thus, the process cartridge 15 can be taken out of the apparatus main frame 10 without anxiety and without requiring skill, by pulling out slightly from the second position at first and then moving sufficiently.

Figure 6:
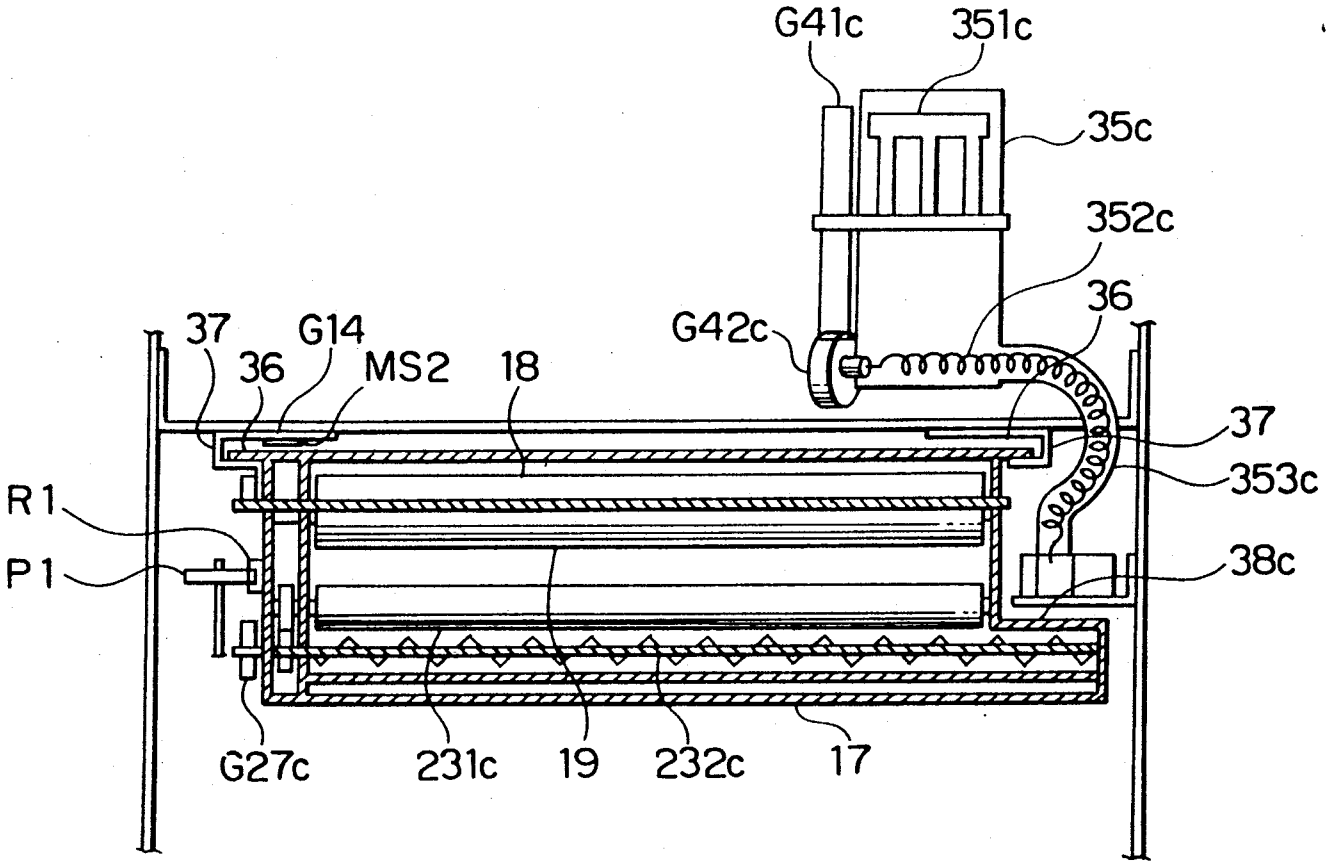
FIG. 6 is a sectional view taken on line A—A in FIG. 1.

On the contrary, when inserting the process cartridge 15 in the apparatus main frame 10, it is very simple and can be done safely and certainly within a short period of time without requiring any anxiety for damaging surrounding members that the process cartridge 15 is inserted being guided by the internal surface of the opened front cover 14 with protrusion 36 on the process cartridge 15 following the guide member 37 in the chamber for housing a process cartridge, rack R and pinion P engage each other, the process cartridge 15 arrives at the second position shown in FIG. 23-*c*, and it passes through the point slightly and further advances to the point where the second microswitch MS2 is turned on as shown in FIG. 6 (*b*).

In order to move the process cartridge 15 from the position mentioned above to the first position where an image can be formed, the process cartridge 15 staying at the second position is further inserted or a button on operation panel 11 is pressed for inputting set signals in the control unit. The control unit, upon receiving the signals, sends signals to motor M2 and to electromagnetic clutch C22, and causes pinion P to rotate (in the direction opposite to that for pulling out) for moving the process cartridge 15 from the second position to the first position, thus moves the process cartridge 15 toward the first position along guide member 37 precisely, safely and automatically (FIG. 23-*b*).

Further, when the process cartridge 15 moves, the first microswitch MS1 detects that the process cartridge 15 has moved to the first position as shown in FIG. 23-*a*, and sends that signal to the control unit. The control unit, upon receiving the signal, releases the electromagnetic clutch C22 and causes the motor M2 to stop running. To be concrete, the process cartridge 15 stops at the first position, and driving gear G14 provided on the process cartridge 15, developing unit driving gears G27*a*–G27*d* and waste toner screw driving gear G34 engage respectively with gear G13, gears G26*a*–G26*d* and gear G33, thus resulting in a state wherein an image can be formed. In this case, to the toner supply inlets 38*a*–38*d* of respective developing units 23-*a*–23-*d* in the process cartridge 15, tip joint portions of toner transport tubes 353*a*–353*d* of the corresponding toner hoppers 35*a*–35*d* are respectively connected automatically to create the state wherein toners can be supplied. Incidentally, while moving, the joint portions are disconnected automatically and shutters are closed, which is not illustrated. However, even when inlets on the developing units are kept opened upward, toners do not fall because the cartridge is kept horizontally or kept almost horizontally, which is an advantageous point. After replacement of process cartridges or jam clearance, therefore, the process cartridge 15 can be inserted automatically by a simple operation, which frees an operator remarkably from troublesome and sets the process cartridge 15 to the position where an image can be formed certainly.

On the other hand, an upper cover opening means will be explained, referring to FIG. 7. Upper cover 12 is supported rotatably by upper cover shaft 39. Further, by means of coil spring 40 wound round the upper cover shaft 39 and pin 41 whose one end is attached on the apparatus main frame and the other end is attached on the upper cover, the upper cover 12 is urged in the direction for opening, namely, in the counterclockwise direction in the same figure. Solenoid 42 is arranged so that it can hold the upper cover 12 when it is closed.

Owing to the upper cover opening means having the aforementioned structure, the upper cover 12 is closed during the image forming process and it also serves as a delivery tray for an image-transfer material after transferring that is ejected by delivery roller 31 (FIG. 24-*a*). On the occasion of jam clearance or the like, when a pull out button on operation panel 11 provided on the front side of the apparatus main frame 10 is pressed and image forming process signals are not generated, the control unit sends movement signals to a process cartridge moving means for moving the process cartridge 15 as stated above, and sends opening signals to solenoid 42 that is an upper cover opening means. The solenoid 42, upon receiving the opening signals, retreats its shaft, namely releases the upper cover from holding. Then, the spring urged upper cover 12 is released by the urging force (FIG. 24-*b*). Through the opening formed by the upper cover 12 thus opened, it is possible to locate simply the jammed image-transfer material and to remove it easily. Incidentally, an upper cover opening means of the invention is not limited to that in the present invention, and it is also possible to provide a member that can hold the process cartridge on the opposite side against the upper cover shaft 39. It is further possible to employ a technology wherein a gear and a motor which engages with the gear are provided on upper cover shaft 39, and when opening signals are generated from the control unit, the motor rotates to open the upper cover 12. In this case, it is also possible to arrange so that the motor rotates reversely to close the upper cover 12 when set signals are inputted in the control unit.

Since a mechanism for opening and closing the front cover 10 on the front side is the same as that for the aforementioned upper cover in term of structure, further detailed explanation will be omitted.

Movement control for the process cartridge 15 and opening control for the upper cover 12 and the front cover 14 both explained above are shown in FIG. 28. Namely, pull-out signals are inputted in the control unit and indicated on the operation panel 11. In this case, when print signals are not generated from an operation portion and photoreceptor belt driving signals, fixing and sheet delivery driving signals and sheet feeding driving signals are not generated respectively from a photoreceptor belt driving unit, a fixing and sheet delivery driving unit and a sheet feeding unit, the control unit sends movement signals to a process cartridge moving means. In order to move the process cartridge 15 to the second position from the first position, the process cartridge moving means controls a process cartridge movement driving system and stops it when position detection signals which represent detection that the process cartridge 15 has moved to the second position are obtained. The control unit, on the other hand, sends movement signals to the process cartridge moving means and, concurrently with that, also sends opening signals to an opening means for the upper cover 12 and to an opening means for the front cover 14, and thereby opens the upper cover 12 and the front cover 14. In other words, when jamming occurs or when replacing process cartridge 15, troubles are first detected and then the image forming operation is stopped. Then, the contents thereof are displayed in a form of a message on operation panel 11 in a flashing manner, and interlocking with this, the front cover 14 opens as shown in FIG. 9, the process cartridge 15 retreats to the second position, and the upper cover 12 opens. Thereby, the state of a unit member where jamming occurs can be observed closely through the upper portion of the apparatus main frame 10, and jammed image-transfer material can be identified and taken out easily. Further, when a photoreceptor belt reaches its life in terms of the number of usage cycle or when an intermediate maintenance inspection is necessary, the relevant sign appears on the operation panel 11 and the process cartridge 15 located at the second position is further drawn out slightly, for its replacement work in the maintenance inspection, by an operator who can pull out the process cartridge 15 by sliding it on guide surface 14A on the internal side of the opened front cover 14, resulting in easy maintenance inspection of process cartridge 15 and easy replacement of parts.

Incidentally, when the command for opening movement from the first position to the second position, namely the release command is generated for clearance of jammed image-transfer material or for repair or replacement of the process cartridge 15 in its maintenance inspection, all of opening of the front cover 14, opening of the upper cover 12 and release of process cartridge 15 can be carried out at the same time, or releasing can be started first and then the detection of that start of releasing can cause the aforementioned upper cover 12 and front cover 14 to open.

Further, it is also possible that a part of the process cartridge 15 serves as a front enclosure to construct a well-shaped image forming apparatus. In this case, however, it is impossible for the front cover to serve as a guide when the process cartridge is pulled out, and therefore, it may naturally be difficult to a certain extent for pulling out the process cartridge.

In addition to the above, toner supply sign, waste toner full sign and no paper in sheet feed cassette sign appear on the operation panel 11, and thereby actions can be taken intuitively and easily. Since waste toner collection box 26 located at the rear side of the process cartridge 15 is protruded outside of the apparatus main frame 10 when the process cartridge 15 is retreated to the second position, waste toners collected in the box 26 can easily be removed together with a bag.

In the present example, there has been explained an image forming method wherein a color toner image is formed on a photoreceptor belt and the color toner image is transferred onto an image-transfer material at a stroke, as an image forming process. However, it is also possible to employ a color image forming method wherein toner images are transferred repeatedly onto an image-transfer sheet wound round a transfer drum. Further, the invention can be applied even to a conventional monochromatic printer employing a monochromatic process. As a developing method, on the other hand, there has been explained a non-contact developing method, but the invention can be applied also to a contact type developing method without being limited to the non-contact developing method. Further, driving systems shown in the present example represent only an example, and the driving system is not naturally limited only to the combination of these gears, clutches, and belts.

In FIG. 27, an image forming apparatus of a transfer drum type is shown as another example to which the invention is applied. In that image forming apparatus, a portion of process cartridge 15 is almost the same as that in the previous example, but toner hopper 35*a* is incorporated in the process cartridge 15 as a unit. In the image forming apparatus of a transfer drum type, transfer drum 50 is kept to be in contact with the transfer portion of the photoreceptor belt 17, and the transfer drum 50 rotates counterclockwise synchronizing with the photoreceptor belt 17. On the peripheral surface of the transfer drum 50, there is wound an image-transfer material onto which a toner image of each color formed on the photoreceptor belt 17 is transferred so that images of different colors are superposed on the image-transfer material, and after the transferring, the image-transfer material is separated from the transfer drum 50 and is ejected on the top of the apparatus main frame 10 after being fixed.

In the image forming apparatus in the present example, the transfer drum 50 is not included in the movable process cartridge 15 but is on the apparatus main frame 10. Therefore, the process cartridge 15 can be moved in the same manner as in the previous example.

When the process cartridge 15 is moved from the first loading position to the second loading position, the upper cover 12 is opened to create enough space around transfer unit 24, transport path 29, and fixing unit 30, resulting in easy action to be taken for troubles. However, if such condition continues as it is, an exposure portion of the photoreceptor belt is subjected to light-fatigue. Therefore, photoreceptor cover 372 that is movable around supporting shaft 371 fixed on the main frame is provided at the tip portion along the guide member 37 provided on the main frame 10 for guiding the process cartridge 15, and the photoreceptor cover is urged constantly counterclockwise by a torque spring. When the process cartridge 15 is in the first loading position, the photoreceptor belt is lifted by the upper surface at the tip of the cartridge and is opened to transfer unit 24 to face it or to transfer drum 50 to face it as shown in FIG. 1 and FIG. 10.

However, when the process cartridge 15 is in the second position as shown in FIG. 26, the exposure portion on the photoreceptor at the tip of the process cartridge 15 is surrounded by the photoreceptor cover 372 to be light-tight.

On the other hand, for a neutralizing device composed of a neutralizing lamp or a neutralizing electrode or for functioning member block 102 provided with an exposure means, opening 154 and opening 155 are provided at locations corresponding to the process cartridge in the first position. Thus, the photoreceptor belt 17 can be neutralized by the image-transfer material after transferring.

However, when the process cartridge 15 retreats to the second position and the upper cover 12 is opened, external light enters through openings 154 and 155 to cause the photoreceptor to be subjected to light-fatigue. In order to prevent this, when the process cartridge 15 retreats to the second loading position, the aforementioned openings 154 and 155 move along the guide member 37 to hide behind stand 103 for toner hopper 35 provided on the main frame 10 or behind shielding plate 103A specifically provided as shown in FIG. 10, so that light-tight condition may be kept.

As described in detail above, in the image forming apparatuses in examples of the invention, signals representing trouble occurrence, end of life in terms of the number of usage cycles and waste toner full cause the process cartridge to retreat from an image-formable position interlocking the aforementioned detection signals and cause the upper cover and the front cover to open, thus enabling it to take actions for troubles simply and surely.

Further, in the image forming apparatus of the invention, a process cartridge moves automatically and an upper cover opens with a simple operation, enabling an operator replace the process cartridge easily without hesitating using a force which is not great. In addition, for jam clearance, the process cartridge retreats to the second position, enabling an operator to view the inside of the apparatus main frame through the opening formed by the opened upper cover and creating and securing enough work space for remarkable improvement in work efficiency for jam clearance. Further, when taking out jammed sheet of image-transfer material, there is no risk that an image carrier is scratched or damaged and the image carrier is touched by operator's hands directly. Furthermore, the process cartridge can mechanically be moved horizontally or at an inclined angle that is almost horizontal, and opened external covers can guide the process cartridge when it is removed from its second position or is inserted in the second position. Therefore, it is possible to replace process cartridges or clear jamming without giving unnecessary vibration to the process cartridge and with little spew of developers, resulting in improvement in maintainability. Incidentally, when the present image forming apparatus is a color printer, all of loading and unloading of a process cartridge and a cassette, jam clearance and toner supplying can be done through the front side of the apparatus. Therefore, maintainability with easy usage similar to that in one direction operation on a monochromatic printer has been realized.

What is claimed is:

1. An image forming apparatus comprising:

an image carrying body for forming a latent image on a surface thereof;

developing means for forming a developed image from the latent image;

means for transferring the developed image to a recording sheet;

means for cleaning the surface of the image carrying body after the developed image has been transferred from the surface of the image carrying body to the recording sheet;

a process-cartridge including the image carrying body and at least one of the developing means and the cleaning means, said process-cartridge being insertable into a main body of the image forming apparatus by a movement in an insertion direction until a first position is reached where image forming can occur, said process-cartridge being releasable in a release direction which is opposite in direction to the insertion direction by a movement from the first position to a second position so as to form an open space that provides room for an operator to have manual access to the transferring means;

driving means responsive to a first moving signal for driving the process-cartridge to move in the release direction from the first position to the second position;

an upper cover rotatably provided on an upper portion of the main body;

detecting means responsive to an opening of the upper cover by the rotation thereof for generating an open cover position signal; and control means responsive to the open cover position signal for generating the first moving signal for transmission to the driving means for moving the process-cartridge from the first position to the second position.

2. The image forming apparatus of claim 2, further comprising:

manual operation means for transmitting upon operation thereof, a command signal to said control means, said control means generating the first moving signal for driving the process-cartridge from the first position to the second position in response to the command signal.

3. The image forming apparatus of claim 1, further comprising:

means for generating a closed position signal when the upper cover is closed;

means for generating a second position signal when the process-cartridge is positioned at the second position; and wherein said control means is responsive to both of the closed position signal and the second position signal for transmitting a control signal to the driving means to move the process-cartridge from the second position to the first position.

4. An image forming apparatus comprising:

an image carrying body for forming a latent image on a surface thereof;

developing means for forming a developed image on the surface of the image carrying body;

transferring means for transferring the developed image onto a recording sheet;

means for cleaning the surface of the image carrying body after the developed image has been transferred from the image carrying body onto the recording sheet;

a process-cartridge detachably provided in a main body of the image forming apparatus, said process-cartridge including at least the image carrying body, which is insertable into and detachably from the main body, through an entrance;

an entrance cover for closing and opening the entrance;

locking means having a mechanical linkage coupled to the entrance cover for locking the process-cartridge at a first image forming position, said locking means respectively locking and releasing the process-cartridge as the entrance cover is opened and closed; and driving means for moving the process-cartridge from the first image forming position to another position adjacent to the entrance when the entrance cover is opened, said process-cartridge being removable from the main body of the image forming apparatus at the another position, and for moving the process-cartridge from the another position to the first position when the entrance cover is closed; and wherein an open space is formed over the transferring means by the movement of the process-cartridge to said another position, said open space providing an operator with room to manually access the transferring means.

5. An image forming apparatus comprising:

a main frame to support a main body of the image forming apparatus;

a process-cartridge provided in the main body and slidably supported by the main frame, said process-cartridge including at least an image carrying body, and being movable from a first position where image forming on the image carrying body occurs, to a second position, by a movement in an upwardly inclined direction toward an insertion entrance in the main body, the process-cartridge being insertable into the main body through said insertion entrance;

an outer cover to close and open the insertion entrance;

means for generating a release signal whenever maintenance is required and whenever a jam in conveyance of a recording sheet is sensed;

means for moving the process-cartridge from the first position to the second position responsive to the release signal; and means for opening the outer cover responsive to the release signal.

6. An image forming apparatus for forming an image, comprising:

an image carrying body for forming a latent image on a surface thereof;

developing means for forming a developed image from the latent image;

means for transferring the developed image to a recording sheet;

means for cleaning the surface of the image carrying body after the developed image has been transferred from the surface of the image carrying body to the recording sheet;

a process-cartridge including the image carrying body and at least one of the developing means and the cleaning means, said process-cartridge being insertable through an insertion entrance into a main body of the image forming apparatus by a movement in an insertion direction until a first position is reached where image forming can occur, said process-cartridge being releasable in a release direction which is opposite in direction to the insertion direction by a movement from the first position to a second position;

at least one recording sheet cassette for holding at least one recording sheet;

driving means responsive to a first moving signal for driving the process-cartridge to move in the release direction from the first position to the second position;

an upper cover rotatably provided on an upper portion of the main body;

moving means for moving the at least one recording sheet cassette from an operational position to another position for facilitating recording sheet jam clearing;

an entrance cover for opening and closing the insertion entrance to the main body;

detector means responsive to an opening of the upper cover for generating a first open cover position signal and for generating a second open cover position signal responsive to the opening of the insertion entrance cover;

control means responsive to the first open cover position signal for generating the first moving signal for transmission to the driving means for driving the process-cartridge from the first position to the second position;

said control means responsive to the first open cover position signal for generating a moving signal for transmission to the moving means for moving the at least one recording sheet cassette from the operational position to the another position; and said control means further including means responsive to the second open cover position signal for also generating the first moving signal for transmission to the driving means to drive the process-cartridge to move from the first position to the second position, whereby opening of the upper cover causes the cassette and the process-cartridge to be moved to thereby facilitate recording sheet jam clearing, and opening of the entrance cover causes the process-cartridge to move from the first position to the second position to facilitate removal of the process-cartridge from the image forming apparatus.

* * * * *